US010369438B2

(12) United States Patent
Orme et al.

(10) Patent No.: US 10,369,438 B2
(45) Date of Patent: Aug. 6, 2019

(54) SHAFT HOLDING DEVICE

(71) Applicant: Designlynx Products, LLC, Skippack, PA (US)

(72) Inventors: Brian M. Orme, Phoenixville, PA (US); Jeremy M. Fallis, Jr., Bethlehem, PA (US); Michael A. Koether, North Burnswick, NJ (US); Daniel Shanahan, Drexel Hill, PA (US); Nicholas J. Nawa, Mohnton, PA (US)

(73) Assignee: DESIGNLYNX PRODUCTS, LLC, Skippack, PA (US)

( * ) Notice: Subject to any disclaimer, the term of this patent is extended or adjusted under 35 U.S.C. 154(b) by 178 days.

(21) Appl. No.: 15/550,533

(22) PCT Filed: Feb. 12, 2016

(86) PCT No.: PCT/US2016/017816

§ 371 (c)(1),
(2) Date: Aug. 11, 2017

(87) PCT Pub. No.: WO2016/130957

PCT Pub. Date: Aug. 18, 2016

(65) Prior Publication Data

US 2018/0036607 A1 Feb. 8, 2018

Related U.S. Application Data

(60) Provisional application No. 62/115,645, filed on Feb. 13, 2015.

(51) Int. Cl.
*A47F 7/00* (2006.01)
*A63B 55/10* (2006.01)
(Continued)

(52) U.S. Cl.
CPC ..... *A63B 55/10* (2013.01); *A63B 57/203* (2015.10); *A63B 57/207* (2015.10);
(Continued)

(58) Field of Classification Search
CPC ..... A63B 55/10; A63B 57/203; A63B 57/207; A63B 2071/024; A63B 2207/02; A63B 2209/08
(Continued)

(56) References Cited

U.S. PATENT DOCUMENTS 1,575,023 A * 3/1926 Walton ..... A63B 55/10 211/70.2
1,661,500 A * 3/1928 Reach ..... A63B 55/10 294/159
(Continued)

FOREIGN PATENT DOCUMENTS

DE 19900252 C1 1/2000

OTHER PUBLICATIONS

Rival and Revel (Facebook) Feb. 7, 2015 (Feb. 7, 2015) [online] Retrieved from the internet: <URL: www.Facebook.com/RivalAndRevel/timeline> entire document.
(Continued)

*Primary Examiner* — Fenn C Mathew
*Assistant Examiner* — Cynthia F Collado
(74) *Attorney, Agent, or Firm* — Morgan, Lewis & Bockius LLP

(57) ABSTRACT

A shaft holding device comprises a body that has a top and a bottom and a central axis extending between the top and the bottom. A length of the body measured along the central axis is larger than a largest dimension measured perpendicular to the central axis. A plurality of slots is formed by the body and each is configured to releasably secure a shaft therein. Each of the plurality of slots has an axis spaced from
(Continued)

and generally parallel with the central axis. Each of the plurality of slots is open along a side of the body and, for each cross section along the length of the body taken about a plane perpendicular to the central axis, each inner circumferential width of an opening of each of the plurality of slots is smaller than a diameter of each of the plurality of slots.

19 Claims, 30 Drawing Sheets

(51) Int. Cl.
*A63B 57/20* (2015.01)
*A63B 71/02* (2006.01)

(52) U.S. Cl.
CPC ..... *A63B 2071/024* (2013.01); *A63B 2207/02* (2013.01); *A63B 2209/08* (2013.01); *A63B 2209/10* (2013.01); *A63B 2220/12* (2013.01); *A63B 2225/54* (2013.01)

(58) Field of Classification Search
USPC ..... 206/315.2, 315.1, 315.6; 211/70.2; 294/159, 143; 473/282
See application file for complete search history.

(56) References Cited

U.S. PATENT DOCUMENTS 2,533,541 A 12/1950 Warring
3,116,730 A 1/1964 Tingley
4,074,739 A 2/1978 Rodeghier
4,111,248 A 9/1978 Leichhardt
4,616,749 A 10/1986 Briggs
5,366,075 A 11/1994 Mills
5,417,334 A 5/1995 Wu
D364,912 S 12/1995 Sowers
5,669,514 A 9/1997 Massetti
5,820,479 A * 10/1998 Cline ..... A63B 55/10 473/282
5,918,490 A 7/1999 Lion
5,931,317 A * 8/1999 Zusack ..... A63B 47/002 211/70.2
D486,875 S 2/2004 Hale et al.
7,124,899 B1 10/2006 Wright
D620,542 S 7/2010 Sheffield
7,854,664 B1 12/2010 Comrie
7,857,150 B2 12/2010 Young
8,066,119 B2 11/2011 Doman
D659,788 S 5/2012 VanNostran
8,287,399 B2 * 10/2012 LaCombe ..... A63B 55/00 473/282
8,640,866 B1 2/2014 Dow
2004/0198527 A1 * 10/2004 Hsieh ..... A63B 55/10 473/282
2006/0163893 A1 7/2006 Gascolgne
2006/0178225 A1 8/2006 Hall
2007/0155528 A1 * 7/2007 Miller ..... A63B 55/10 473/282
2007/0202961 A1 * 8/2007 Andren ..... A63B 57/00 473/282
2008/0006547 A1 1/2008 Pace
2008/0264881 A1 10/2008 Rydzynski
2009/0042662 A1 * 2/2009 Staszak ..... A63B 55/10 473/282
2009/0111601 A1 * 4/2009 Fletcher ..... A63B 55/10 473/282
2011/0034264 A1 * 2/2011 Mitsumoto ..... A47F 7/0021 473/282
2011/0127183 A1 6/2011 Davis, Jr.
2011/0215013 A1 * 9/2011 Young ..... A63B 55/10 206/315.2
2011/0269564 A1 * 11/2011 Mitchell ..... A63B 47/02 473/282

OTHER PUBLICATIONS

Written Opinion of the International Searching Authority dated May 2, 2016 for International Patent Application No. PCT/US2016/017816, 6 pp.
International Search Report dated May 2, 2016 for International Patent Application No. PCT/US2016/017816, 2 pp.

* cited by examiner

SHAFT HOLDING DEVICE

CROSS-REFERENCE TO RELATED APPLICATIONS

This application is a U.S. National Stage of International Patent Application No. PCT/US2016/017816, filed Feb. 12, 2016, which claims the benefit of U.S. Provisional Patent Application No. 62/115,645 filed Feb. 13, 2015 entitled "Shaft Holding Device", each of which is incorporated by reference herein in its entirety.

FIELD OF THE INVENTION

The present invention generally relates to devices and methods for securing and carrying elongated members, such as golf clubs.

BACKGROUND

Sets of articles often need to be kept in a case, container or bag to keep the articles together and allow for them to be transported. For example, golf clubs are typically stored and carried loosely in a golf bag. However, golf bags are bulky and not easily carried or stored. In addition, golf bags may not fit easily within a space such as within a trunk of a car and may not be necessary in situations where only a limited number of clubs are needed. Further, carrying clubs within a golf bag in a metropolitan environment or on public transportation to indoor golf centers or golf driving ranges may be difficult or impractical.

When a limited number of golf clubs are used, such as leaving the bag on the cart for an approach shot or in other situations where the bag is left behind, the clubs are often carried loosely in a user's hand. Carrying or storing golf clubs loosely may be uncomfortable and awkward. Loose golf clubs are prone to being dropped, lost, or strike someone, something, or each other and any additional clubs must be placed on the ground or leaned against an object while one of them is being used.

There are current products to hold a limited number of clubs. For example, there are small "Sunday Bags" which carry a limited number of clubs. However, within the bag, the clubs may not be fully secured and to access the clubs, the bag must be opened and closed, and the bag still adds considerable weight.

There are also racks and stands to hold a limited number of clubs. However racks do not secure the clubs or allow for portability and the portable stands do not allow for effective storage, organization, or carrying of the clubs. Portable and foldable racks to carry clubs can be heavy and in multiple pieces which may make them difficult to make as well as difficult to use.

Further, at points of sale, rubber bands and hook and loop straps are sometimes used to secure golf clubs. However, the band and straps must be used toward two ends of the clubs, they are easily breakable, and the clubs are not easily accessible. The hook and loop fasteners of straps are difficult to clean and may wear out. In addition, to access a single club, the bands and straps must be removed or opened resulting in loosening all of the clubs. Quickly accessing a club may be critical when the pace of play is important.

Accordingly, improved devices and methods for securing and carrying elongated items, such as golf clubs, are desired.

BRIEF SUMMARY OF THE INVENTION

In one embodiment there is a shaft holding device comprising: a body having a top and a bottom and a central axis extending between the top and the bottom, a length of the body measured along the central axis being larger than a largest dimension measured perpendicular to the central axis; and a plurality of slots formed by the body and each configured to releasably secure a shaft therein, each of the plurality of slots having an axis spaced from and generally parallel with the central axis, each of the plurality of slots being open along a side of the body and, for each cross section along the length of the body taken about a plane perpendicular to the central axis, each inner circumferential width of an opening of each of the plurality of slots being smaller than a diameter of each of the plurality of slots.

In one embodiment, the body includes a core and an outer sleeve mounted on the core. In one embodiment, the outer sleeve includes an elastomeric material. In one embodiment, the core includes a plurality of arms, each of the plurality of arms extending radially between two adjacent slots of the plurality of slots. In one embodiment, each of the plurality of arms each include a split finger end allowing for the circumferential width of each of the plurality of arms to be contracted. In one embodiment, the core includes a top half and a bottom half that are coupled to one another inside of the outer sleeve, the top half of the core extending partially from the top of the outer sleeve and the bottom half of the core extending partially from the bottom of the outer sleeve. In one embodiment, the outer sleeve, including the plurality of slots, is symmetrical about three planes, each of the three planes being perpendicular to one another.

In one embodiment, the plurality of slots are first slots and the body includes at least one second slot extending through the bottom and positioned radially closer to the central axis than each of the plurality of slots. In a further embodiment, the shaft holding device comprises a spike that is configured to releasable mount into the at least one second slot, the spike being generally parallel with the central axis when mounted into the at least one second slot. In one embodiment, each of at least one second slots is configured to releasably retain a golf tee. In a further embodiment, the shaft holding device comprises a golf ball marker, wherein the top of the body includes a recess configured to receive the golf ball marker; and a magnet mounted to the body within the recess and configured to releasably retaining the golf ball marker. In one embodiment, the shaft holding device comprises a threaded insert mounted to the body within the recess and configured to releasably mount a strap loop to the body.

In one embodiment, the body forms an open compressible space between each of the plurality of slots. In one embodiment, the diameter of each of the plurality of slots and an outer circumferential width of each opening of the plurality of slots is larger toward the top and bottom of the body than corresponding dimensions in a mid-section of the body between the top and the bottom of the body. In a further embodiment, the shaft holding device comprises a carrying strap releasably coupled to the top and the bottom of the body. In one embodiment, the length of the body is less than 6 inches and the outermost diameter is less than 2.5 inches. In one embodiment, the body tapers radially inwardly toward the center between the top and bottom. In one embodiment, the plurality of slots include six slots spaced equally around the central axis.

In one embodiment there is a shaft holding device comprising: a body having a top and a bottom and a central axis extending between the top and the bottom, a length of the body measured along the central axis being larger than a largest dimension measured perpendicular to the central axis, the body including an elastomeric material and tapering radially inwardly toward the center between the top and bottom; a plurality of slots formed by the body and each configured to releasably secure a shaft therein, each of the plurality of slots having an axis spaced from and generally parallel with the central axis, each of the plurality of slots being open along a side of the body and, for each cross section along the length of the body taken about a plane perpendicular to the central axis, each inner circumferential width of an opening of each of the plurality of slots being smaller than a diameter of each of the plurality of slots, the diameter of each of the plurality of slots and an outer circumferential width of each opening of the plurality of slots is larger toward the top and bottom of the body than corresponding dimensions in a mid-section of the body between the top and the bottom of the body; and a core extending through the body, the top half of the core extending partially from the top of the outer sleeve and the bottom half of the core extending partially from the bottom of the outer sleeve, the core including a plurality of arms, each of the plurality of arms extending radially between two adjacent slots of the plurality of slots, each of the plurality of arms each including a split finger end allowing for the circumferential width of each of the plurality of arms to contract.

In one embodiment there is a shaft holding device comprising: a body having a top and a bottom and an axis extending between the top and the bottom; and at least one slot formed by the body and configured to releasably secure a shaft therein, the at least one slot having an axis spaced from and generally parallel with the axis of the body, the at least one slot being open along a side of the body and having an inner circumferential width that is smaller than a diameter of the at least one slot, the diameter of the at least one slot and an outer circumferential width of the least one slot being larger toward the top and bottom of the body than corresponding dimensions in a mid-section of the body between the top and the bottom of the body.

BRIEF DESCRIPTION OF THE SEVERAL VIEWS OF THE DRAWINGS

The foregoing summary, as well as the following detailed description of embodiments of the shaft holding device, will be better understood when read in conjunction with the appended drawings of exemplary embodiments. It should be understood, however, that the invention is not limited to the precise arrangements and instrumentalities shown.

In the drawings.

DETAILED DESCRIPTION OF THE INVENTION

Figure 1:
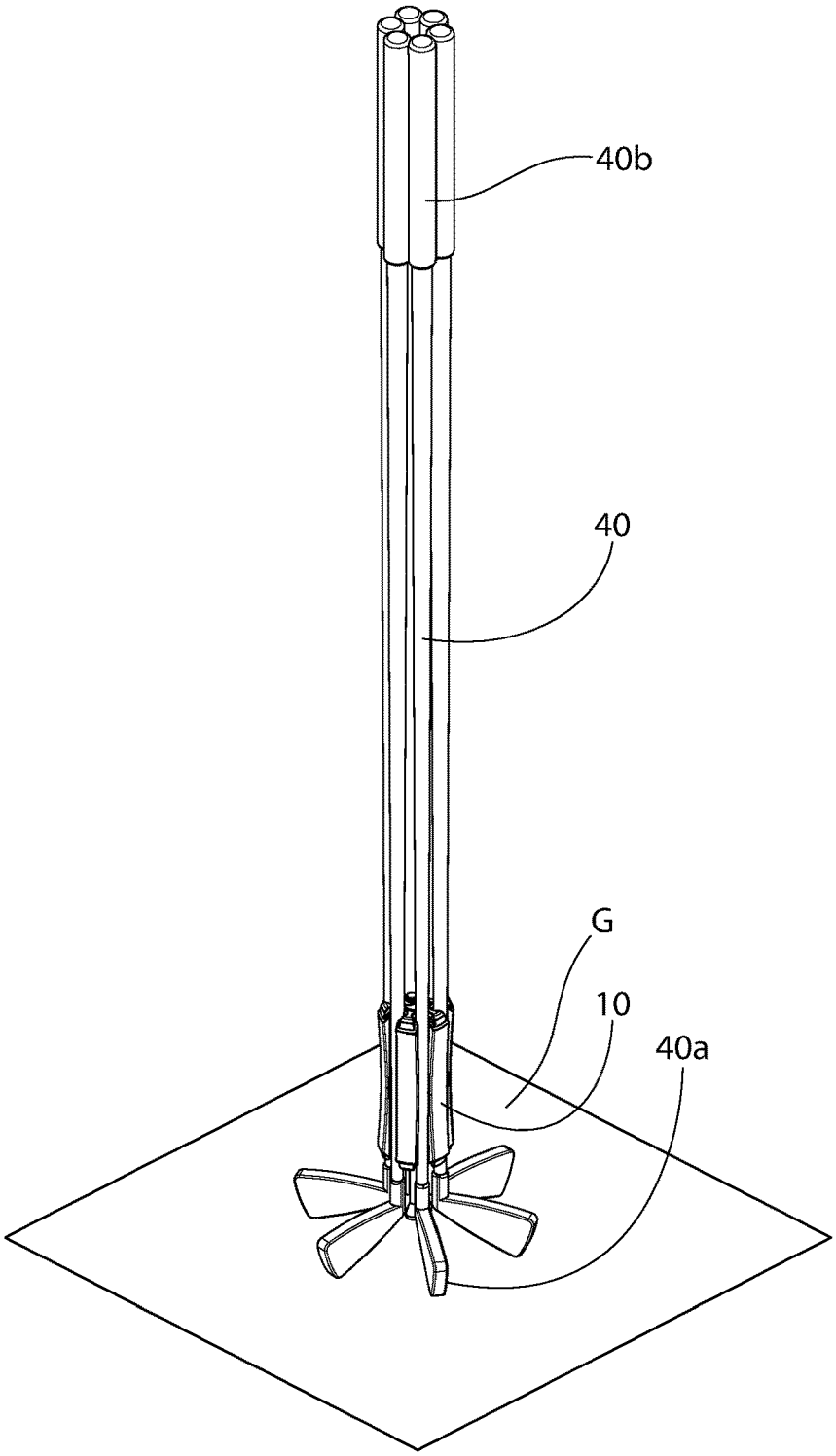
FIG. 1 is a perspective view of a shaft holding device in accordance with an exemplary embodiment of the present invention shown holding a plurality of golf clubs.

Referring to FIG. 1, an exemplary shaft holding device of the present invention, generally designated 10, is shown in use with a set of golf clubs each having a shaft 40. According to an embodiment of the present disclosure, a shaft holding device 10 for holding shafts 40 such as the shafts of golf clubs, has the ability to be carried easily in one hand and has one or more slots configured for each shaft 40 to fit snugly within the structure. The shaft holding device 10 may be used to secure shafts 40 for carrying and storage while saving space and allowing for carrying in a single hand of a user. When configured to have a plurality of slots as discussed in further detail below, the shaft holding device 10 may be configured to allow one shaft 40 to be accessed and available for use while keeping other shafts 40 remain secured. The shaft holding device 10 may be configured to carry a variety of shafts 40 have different lengths and diameters. The shaft holding device 10 may be configured to couple to a shaft 40 proximate the center of gravity of the shaft 40 (e.g., proximate the club heads for golf clubs) where the user would tend to grip the shaft 40 without the shaft holding device 10.

Embodiments of the present disclosure may provide several advantages to a golfer using the shaft holding device 10. For example, the user may carry multiple golf clubs more easily to driving range, in a metropolitan setting, or while approaching with multiple clubs. The shaft holding device 10 may allow a user to store and organize golf clubs more easily and securely when space is limited.

When golfing, some golfers will carry their putter, wedge, and possibly another club when approaching their ball that is near the green. A golfer may have to try and hold all the clubs at once in an unorganized manner. Once they have chipped onto the green, the golfer must put some clubs down onto the ground while putting. This causes the club heads to get wet and even forgotten or lost near the green. The shaft holding device 10, in some embodiments, may keep the grips dry by propping them up just enough for the grips to stay dry and/or allow the clubs to stand vertical on their own (see FIG. 1). The shaft holding device 10 may include a bright color or colors to visually remind the user to pick up their clubs after the hole is complete. The shaft holding device 10 may also provide an organized and easy way to keep clubs together for quick access and organization within the golf bag itself.

The shaft holding device 10 may also help keep clubs from clanking together while being transported. The shaft holding device 10 may also contain features for holding accessories such as tees, golf gloves, balls, or other items that may be desired. A shaft holding device 10 tailored specifically for chip and putt courses may provide slots to hold 2 or 3 clubs, a golf glove, a ball marker, and tees. Such a device may increase pace of play by keeping the golfers' clubs and accessorizes organized and easily accessible throughout the course.

The shaft holding device 10 may hold clubs tightly near the heads of the clubs for the best weight balance while carrying and allow three or more clubs to stand vertically on a generally flat surface. The shaft holding device 10 may allow for one-handed carrying of multiple clubs such as 2-6 clubs. The shaft holding device 10 may taper toward the mid-section to allow for more comfortable one handed carrying. The shaft holding device 10 may be generally symmetrical about a mid-section that is perpendicular to the central axis such that the longitudinal orientation of the shaft holding device 10 relative to the shafts 40 does not matter allowing for quick assembly.

Various embodiments and shapes of the shaft holding device 10 could be used for display of such items in retail or tradeshow environments. The shaft holding device 10 may even be included with the set of clubs being sold. For example, at tradeshows wholesalers sell sets of irons and wrap them in rubber bands to hold them together. The shaft holding device 10 may not only hold these sets of clubs together in a better fashion, but also provide a carrying grip for transport and may provide the wholesaler with a reusable item that can be used to promote their logo and brand.

The shafting holding device 10 may be adapted to other industries and scenarios. For example, the shaft holding device 10 may be configured to carry and organize a grilling tool set including spatulas, tongs, grill forks, grill brushes, and skewers. The shafting holding device 10 may be configured in latch onto or hang from the grill in some fashion. The shafting holding device 10 could alternatively be configured to hold pool cues, fishing rods, and/or ski, hiking and tent poles.

Referring to the drawings in detail, wherein like reference numerals indicate like elements throughout, there is shown in FIGS. 2A-13B additional views of an exemplary shaft holding device 10. Various embodiments of the shaft holding device 10 are described in further detail below in reference to the exemplary embodiment shown in the figures.

Referring to FIGS. 2A-2H, the shaft holding device 10 includes a body 12 having a top 12*a* and a bottom 12*b* and a central axis $A_1$ extending between the top 12*a* and the bottom 12*b*. The shaft holding device 10 may be generally elongated such that a length L of the body 12 measured along the central axis $A_1$ is larger than a largest dimension $D_1$ measured perpendicular to the central axis $A_1$. In one embodiment, the length L of the body 12 is at least two times larger than the outermost diameter $D_1$. In one embodiment, the length L of the body 12 is less than about 6 inches and the outermost diameter $D_1$ is less than about 2.5 inches. In one embodiment, the length L of the body 12 is approximately 5.5 inches and the outermost diameter $D_1$ is approximately 2.2 inches. In one embodiment, the length L of the body 12 is approximately 5 inches to approximately 6 inches. In one embodiment, the diameter $D_1$ is approximately 1 inch to approximately 3 inches. The body 12 may be slightly longer than a width of a palm of an average adult male. In one embodiment, the shaft holding device 10 is roughly the size of a soda can. The body 12 may taper radially inwardly toward the mid-section between the top 12*a* and bottom 12*b*. In one embodiment, the outermost diameter $D_2$ proximate the mid-section of the body 12 is about 2 inches while the outermost diameter $D_1$ proximate the top and bottom ends 12*a*, 12*b* is about 2.2 inches.

The body 12 may be generally cylindrical in shape. In one embodiment, the body 12 is generally a hyperboloid shaped. In one embodiment, the body 12 is generally hour glass shaped. The tapered shape of the body 12 may help improve grip, particularly for users with smaller hands. In other embodiments, the body 12 is any desirable shape such as rectangular, hexagonal prism, or triangular prism. In other embodiment, the body 12 includes indents, ribs or ridges to help a user grip the shaft holding device 10 in one hand. One or more portions of the side surface of the body 12 may include indicia 12*d* such as a logo, message, initials, and/or picture allowing for customization, promotion, and/or decoration. In one embodiment, the indicia 12*d* is interchangeable by, for example, including a removable plate that snap fits to the side of the body 12.

The body 12 may form a plurality of slots 14 each configured to releasably secure a shaft 40 therein (see FIG. 1). In one embodiment, each slot 14 has a generally circular cross section. The slots 14 may also be referred to interchangeably as apertures or grooves. Each of the plurality of slots 14 may have an axis $A_2$ spaced from and generally parallel with the central axis $A_1$. In some embodiments, the axes $A_2$ of the slots 14 may be at an oblique angle relative to the central axis $A_1$. For example, the axes $A_2$ of the slots 14 may be at an oblique angle relative to the central axis $A_1$ such that the aperture is closer to the axis $A_1$ toward a bottom end 12*b* than a bottom end 12*a* of the body 12 such that there is enough room for thicker grips 40*b* that would otherwise interfere with one another when attached to the shaft holding device 10. In some embodiments, such an angle is considered "generally parallel". In other embodiments, the axes $A_2$ of the slots 14 are precisely parallel to the central axis $A_1$. Each of the plurality of slots 14 may be open along a side of the body 12 such that a shaft 40 may be inserted radially into each slot 14. The openings 14*a* the slots 14 may be partially circumferentially closed such that the shaft 40 must expand the opening 14*a* to allow for the shaft 40 to be inserted in the slot 14. Said another way, for each cross section along the length of the body 12 taken about a plane perpendicular to the central axis $A_1$, each inner circumferential width $W_1$ of an opening 14*a* of each of the plurality of slots 14 is smaller than a diameter $D_3$ of each of the plurality of slots 14. In one embodiment, the inner circumferential width $W_1$ of an opening 14*a* is generally constant along the length of the slot 14. In one embodiment, the inner circumferential width $W_1$ of an opening 14*a* is approximately 0.374 inches. The inner circumferential width $W_1$ of an opening 14*a* may slightly taper toward a mid-section of the body 12. In one embodiment, the width $W_1$ of an opening 14*a* tapers slightly from approximately 0.349 inches proximate an end of the body 12 to approximately 0.304 inches toward the mid-section of the body 12.

The shape of the slot 14 may snap fit around the shaft 40 to form a sturdy securement requiring more than an incidental force to remove the shaft 40 from the shaft holding device 10. In some embodiments, one or more slots 14 includes a flap or latch that closes at least a section of a slot 14 around the entire diameter of the shaft 40 once the shaft 40 is in place to further secure the shaft 40 in the slot 14. In one embodiment, one or both ends 12*a*, 12*b* of the body may include a locking mechanism that is rotated about the central axis A1 to close at least a portion of each slot 14 and retain the shaft 40 in the slot 14 unless the locking mechanism is released.

Figure 2B:
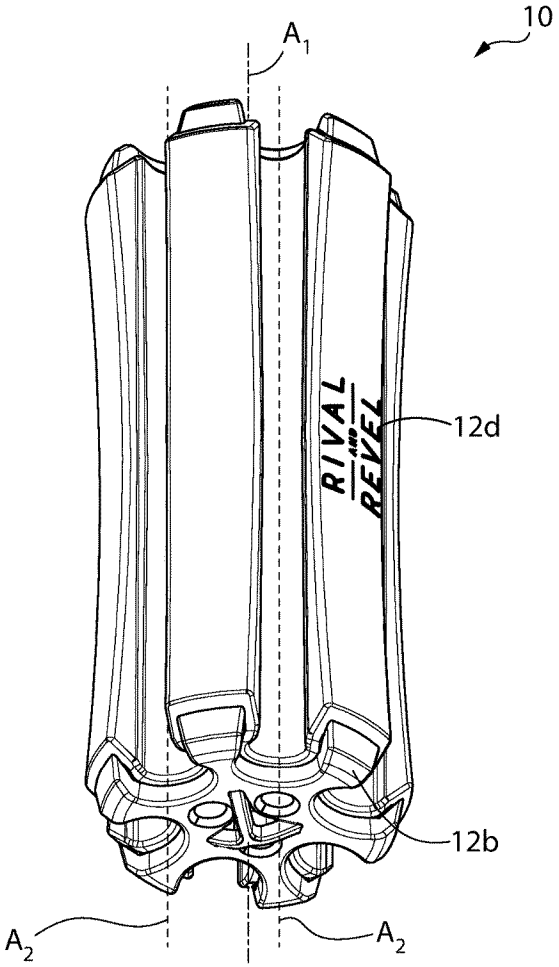
FIGS. 2A and 2B are top and bottom perspective views respectively of the shaft holding device of FIG. 1.
Figure 2A:
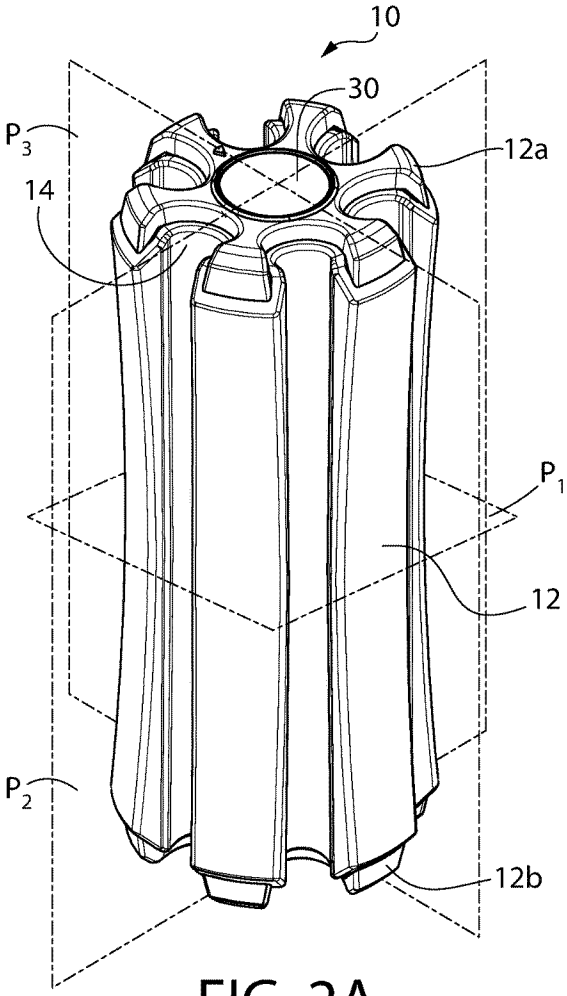
Figure 2F:
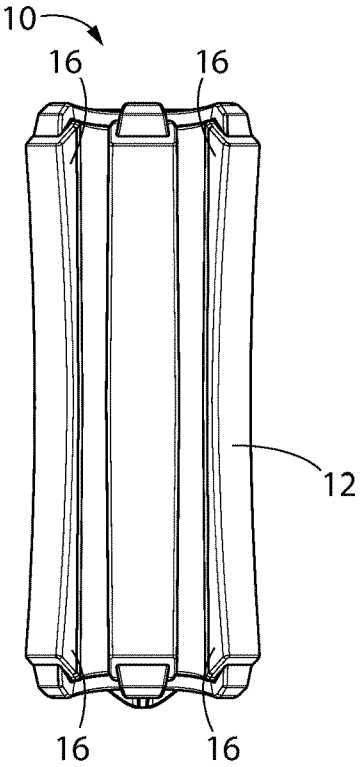
FIGS. 2C-2H are right, front, left, rear, top and bottom side views respectively of the shaft holding device of FIG. 1.
Figure 2E:
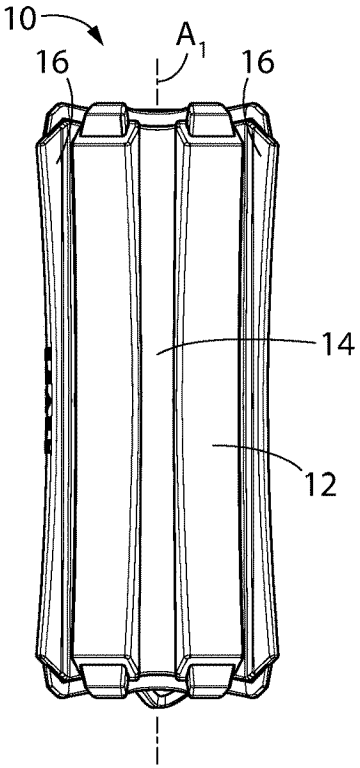
Figure 2D:
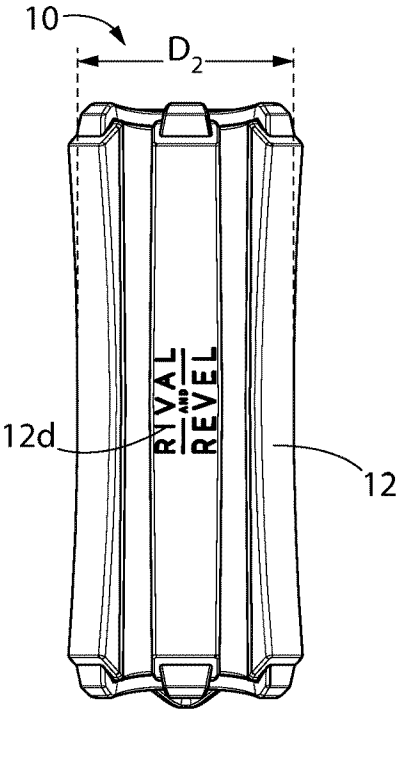
Figure 2C:
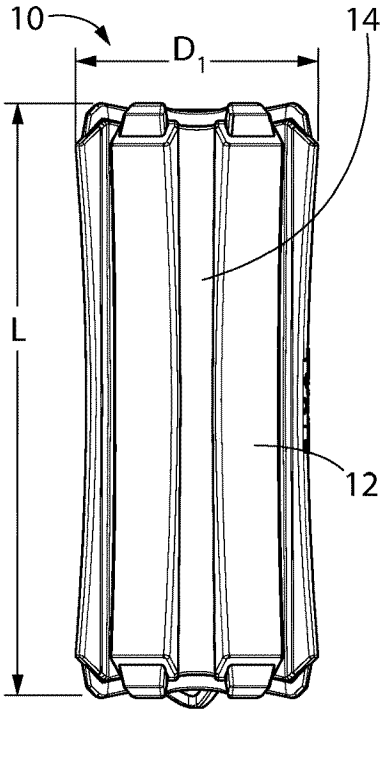
Figure 2G:
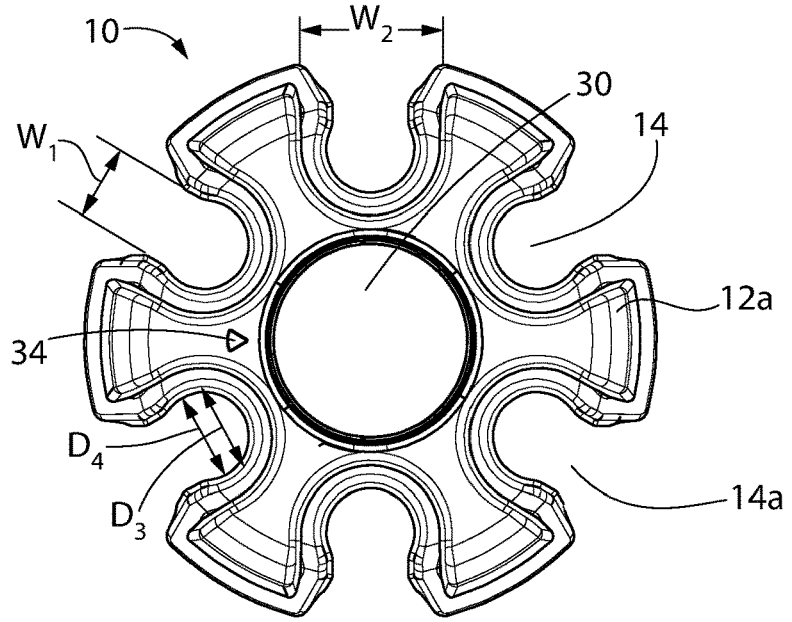
Figure 2H:
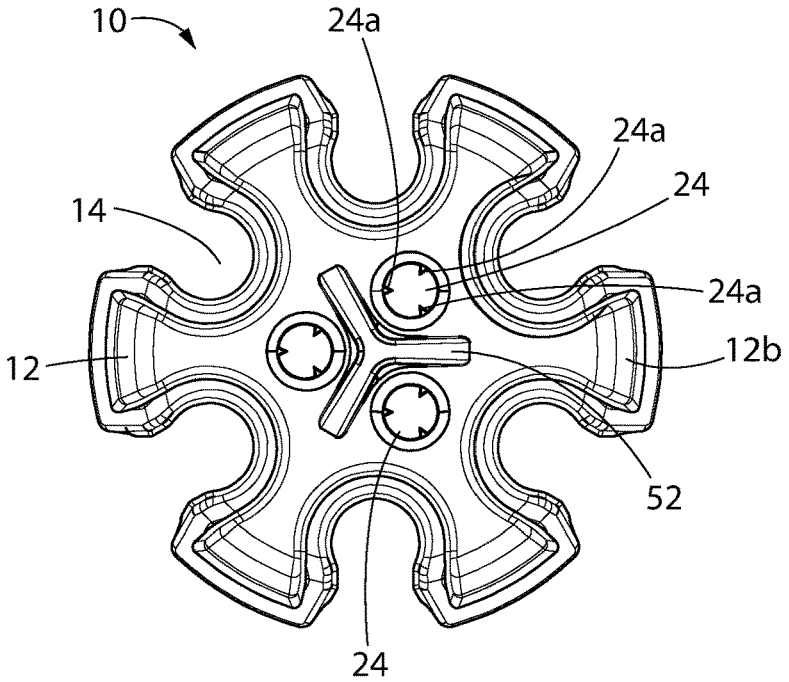

Referring to FIGS. 2B and 2G, the slots 14 may be shaped to allow for easier insertion of a shaft 40 and improved retention. The cross sectional shape of the aperture 40 may generally correspond to the shaft 40. In one embodiment, the cross sectional shape of the aperture 40 is generally circular. In one embodiment, the diameter $D_3$ of each slot 14 is larger toward the top 12*a* and bottom 12*b* of the body 12 than the diameter $D_4$ at a mid-section of the body 12 between the top 12*a* and the bottom 12*b* of the body 12 (see FIGS. 2G and 5). In one embodiment, each slot 14 is generally hour glass shaped. This tapering, or flaring in the opposite direction, of the slot diameters $D_3$, $D_4$ may help to retain the shaft 40 in the slot 14 and accommodate shafts 40 having different diameters than one another. In one embodiment, the diameter $D_3$ tapers from approximately 0.380 inches proximate one end to the diameter $D_4$ of approximately 0.346 inches proximate a mid-section of the body 12 and then flares back to the diameter $D_3$ of approximately 0.380 inches proximate another end of the body 12. Though the shaft 40 may contact the entire slot 14 along the length of the slot 14, the shaft 40 may be held most firmly toward the mid-section of the body 12.

In one embodiment, an outer circumferential width $W_2$ of each opening 14*a* of the plurality of slots 14 is larger toward the top 12*a* and bottom 12*b* of the body 12 than at a mid-section of the body 12 between the top 12*a* and the bottom 12*b* of the body 12. In one embodiment, the outer circumferential width $W_2$ is approximately 0.518 inches towards the ends and approximately 0.374 inches toward the mid-section of the body 12. This tapering, or flaring in the opposite direction, of the opening 14*a* may result in an angled wall 16 that initially receives the shaft 40 and helps guide the shaft into the slot 14 and allows for an initial insertion of the shaft 40 (and easier for embodiments having a flared slot 14 mentioned above) before snapping the remainder of the shaft 40 into the slot 14. In one embodiment, the angled wall 16 is thicker proximate each end of the body 12 than a mid-section due to the taper of the body 12. In one embodiment, opposing angled walls 16 of an aperture 14 are at an oblique angled relative to one another toward the ends 12*a*, 12*b* of the body 12 and are generally parallel to one another toward the mid-section of the body 12 (see FIG. 2I). In one embodiment, the angled walls 16 are convexly curved. In one embodiment, the angled walls 16 are flat.

The body 12 may include one or more slots 14. For example, the body 12 may include one, two, three, four, five, six, seven, eight or more slots 14. The plurality of slots 14 may be spaced equally around the central axis $A_1$. In other embodiments, as discussed below, the slots 14 may be asymmetrically spaced or bunched toward one side of the body 12. In one embodiment, the plurality of slots 14 include six slots spaced equally around the central axis $A_1$. In one embodiment, each slot 14 is identical to one another. In other embodiments, one or more of the slots are a different size. In one embodiment, five of the six slots 14 are identical and one of the slots 14 has a larger or smaller diameter to secure a differently sized shaft 40. In one embodiment, the differently sized slot 14 is color coded so that it is easily identified. For example, a smaller diameter aperture may be provided for a specific club such as a putter and the walls surrounding the aperture may be colored red while the rest of the body 12 is black to indicate where the putter should be inserted.

The slots 14 may be generally the same shape in both longitudinal directions (e.g. symmetrically about plane $P_1$ in FIG. 2A) such that the shafts 40 may be inserted into the slots 14 in either longitudinal direction. Such symmetry may allow a user to use the shaft holding device 10 without having to make sure the shaft 40 is going in a certain direction relative to the shaft holding device 10 for the shaft holding device 10 to function properly. In some embodiments, the shafts 40 are inserted into the shaft holding device 10 in the same longitudinal direction as one another (see FIG. 1). The weight of the club heads 40*a* extending from one end of the shaft holding device 10 may balance out the weight of the longer shafts extending from the other end of the shaft holding device 10. In other embodiments, the shafts 40 are inserted in various directions relative to one another. Though doing so may increase the length of the assembly, a user may decide to insert clubs in various directions relative to one another to prevent club heads 40*a* from touching one another or to balance the weight extending from each end of the shaft holding device 10. In other embodiments, the apertures 14 are asymmetrical in the longitudinal direction (e.g. tapering from one end to another) to better accommodate tapered shafts 40.

Figure 3C:
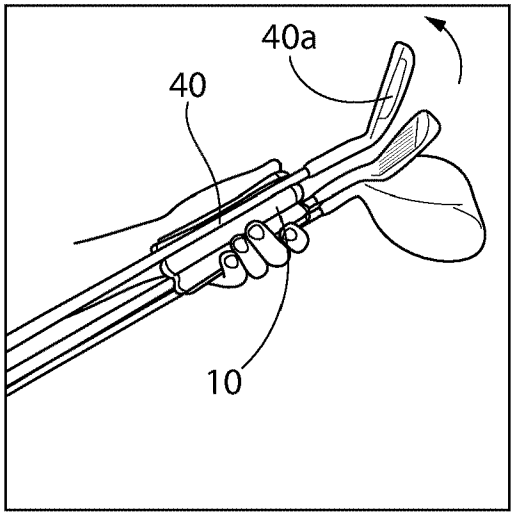
FIGS. 3A-3C are sketches of the shaft holding device of FIG. 1 illustrating the method of inserting a golf club into the shaft holding device.
Figure 3B:
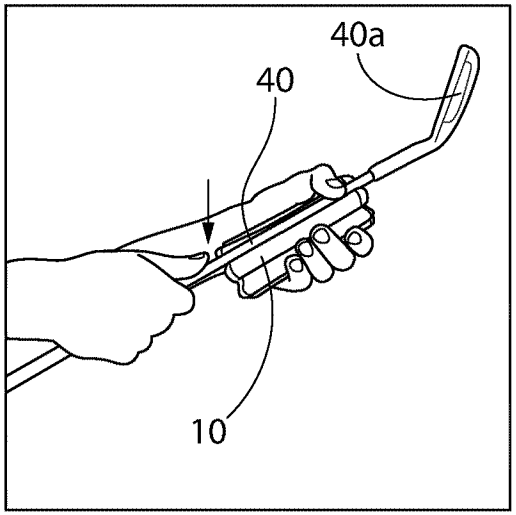
Figure 3A:
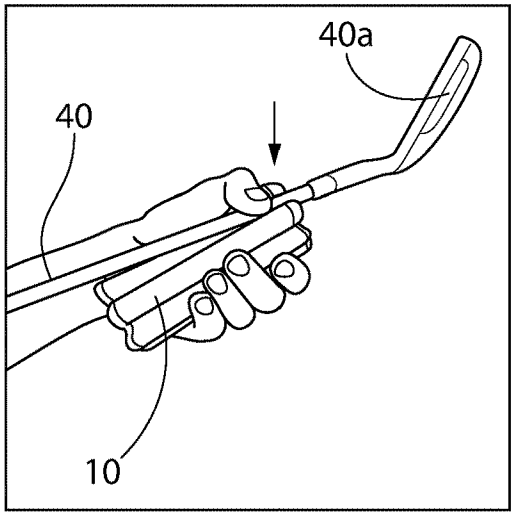

Referring to FIGS. 3A-3C, there is an illustration of an exemplary method of inserting a shaft 40 into a slot 14 of the shaft holding device 10. As shown in FIG. 3A, a user may grip the shaft holding device 10 in one hand with a slot 14 facing them. The user may then insert an end of the shaft 40 nearest to the hosel toward an end 12*a* the shaft holding device 10 such that the shaft 40 is at an oblige angle relative to the central axis $A_1$. The user may use their other hand to press and hold a portion of the shaft 40 in the slot. Referring to FIG. 3B, the user may then pivot the remainder of the shaft toward the shaft holding device 10 until the shaft 40 is generally parallel with the central axis $A_1$ and the shaft 40 is fully inserted into the slot 14. In one embodiment, the shaft 40 snaps into the slot 14 resulting in an audible click. Referring to FIG. 3C, once the shaft 40 is seated in a slot 14 the user may then twist the shaft 40 about the axis $A_2$ of the slot 14 until the club head 40*a* is facing radially away from the central axis $A_1$ such that the club head 40*a* does not contact other club heads and/or helps to act as a base when the clubs are standing vertically (see FIG. 1). To remove a shaft 40 from the shaft holding device 10, the user may grasp the shaft holding device 10 in one hand and pull the shaft away from the shaft holding device 10 using another hand. In one embodiment, the shaft 40 is pivoted away from the shaft holding device 10 relative to the top end of the shaft holding device to release the shaft 40 from the aperture 14 toward the bottom end of the shaft holding device. The shaft 40 may be further pivoted until the entire shaft 40 is released from the aperture 14.

The body 12 of the shaft holding device 10 may form an open compressible space between each of the plurality of slots 14 such inserting a shaft 40 into a slot 14 reduces the impact on the other slots 14. In one embodiment, the body 12 is formed of a monolithic piece of material. Hollow spaces may be provided between adjacent slots 14 to allow for compression between aperutures. In one embodiment, the body 12 is formed of two or more components coupled together. Spaces and or an internal frame or core may allow for the slots 14 to better retain the shafts 40 and act independent from one another. For example, if the body 12 is formed of a monolithic piece of material with no open spaces between slots, inserting a shaft 40 into each slot 14 may expand each slot 14 and compress one or more of the other slots 14 such that after five shafts 40 have been inserted, it is difficult to insert the last shaft 40 into the sixth slot 14.

Referring to FIGS. 4-7, the body 12 may include a core 18 and an outer sleeve 20 mounted on the core 18. The core 18 may provide a more rigid frame for the softer outer sleeve 20.

The core 18 may be comprised of a stiffer material than the outer sleeve 20 and/or be configured to add rigidity in certain areas. The core 18 may have a higher durometer than a durometer of the outer sleeve 20. In one embodiment, the outer sleeve 20 is comprised of an elastomeric material. The outer sleeve 20 may be comprised of silicone rubber. In one embodiment, the outer sleeve 20 has a durometer of 30-90 A. In one embodiment, the outer sleeve 20 has a durometer of 65 A. In one embodiment, the core 18 is comprised of acrylonitrile butadiene styrene (ABS). In one embodiment, the core 18 has a durometer of 80-100 A. In one embodiment, each slot 14 is lined with a material that is different than the material of the outer sleeve 20. For example, each slot 14 may be lined with an even softer elastomeric material. The core 18 and outer sleeve 20 may be configured to isolate each slot 14 to eliminate or reduce the impact of each slot on one another. The core 18 may be configured to help retain the shaft 40 in each slot. The outer sleeve 20 may be configured to provide cushion and a softer material for engaging directly with the shaft 40.

Figure 4:
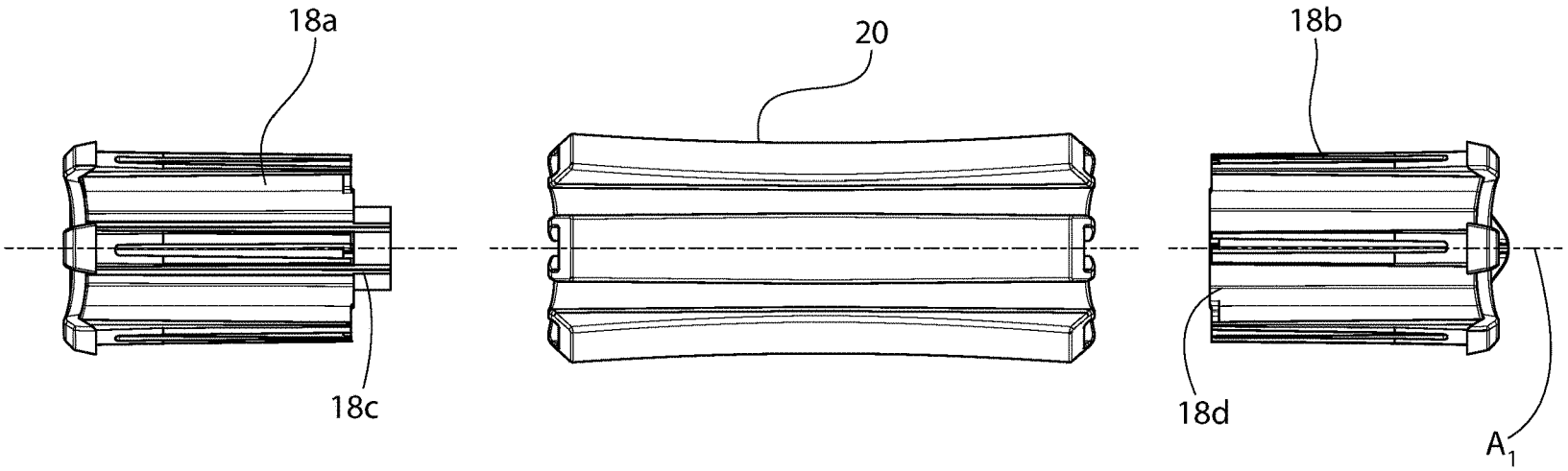
FIG. 4 is a an exploded side view of the shaft holding device of FIG. 1.

Referring to FIG. 4, the core 18 may be comprised of a top half 18*a* and a bottom half 18*b* that are coupled to one another inside of the outer sleeve 20. The top half 18*a* and the bottom half 18*b* of the core 18 may be inserted into either end of the outer sleeve 20 and snap fit and/or be coupled to one another using an adhesive. The core 18 may include radially extending grooves 18*c* and projections 18*d*. The radially extending grooves 18*c* and projections 18*d* may partially overlap with one another to couple the top half 18*a* with the bottom half 18*b* (see FIG. 7). The grooves 18*c* and projections 18*d* may also add radial strength to the core 18.

Figure 5:
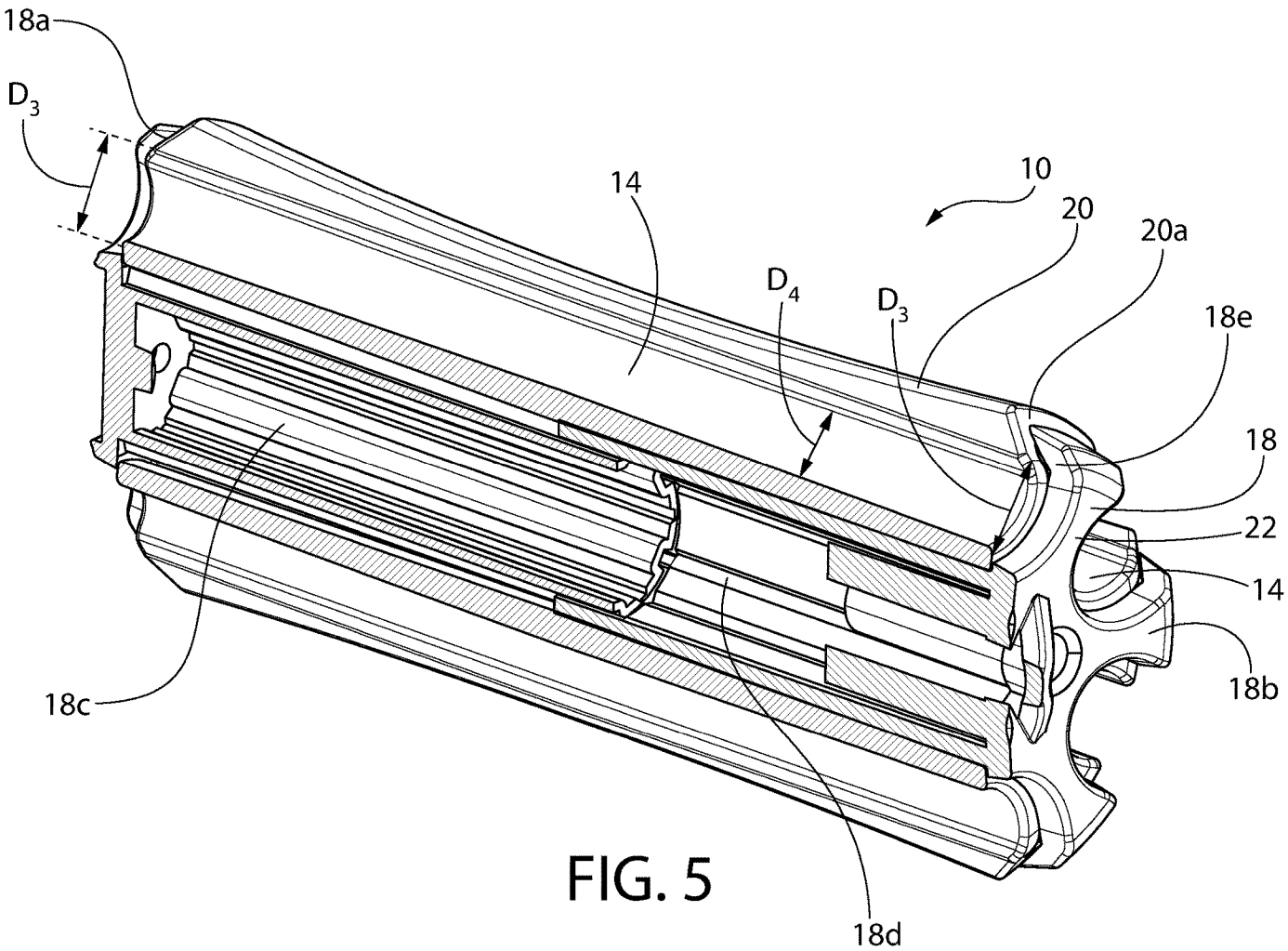
FIG. 5 is a cross sectional side and bottom perspective view of the shaft holding device of FIG. 1.

Referring to FIG. 5, the top half 18*a* of the core 18 may extend partially from the top of the outer sleeve 20 and the bottom half 18*b* of the core may extend partially from the bottom of the outer sleeve 20. One or more arms 22 of the core 18 may include a latch 18*e* configured to extend radially and longitudinally over a top edge 20*a* of the outer sleeve 20. The top edge 20*a* may be positioned between two adjacent slots 14. In one embodiment, the top edge 20*a* has an axially slanted surface. In one embodiment, the core 18 is generally flush with the ends of the outer sleeve 20. In one embodiment, the core 18 is longitudinally recessed within the ends of the outer sleeve 20. The exposed portions of the core 18 may have a distinctive marking or color to form an easily recognizable end cap to help notify users of the location of their clubs and to prevent loss of clubs. The exposed portions of the core 18 may include lights, glow in the dark markings, and/or a tracking device such as a global position system (GPS), Bluetooth, radio-frequency identification (RFID), or low power wide area network (LPWAN) tracker.

Figure 6:
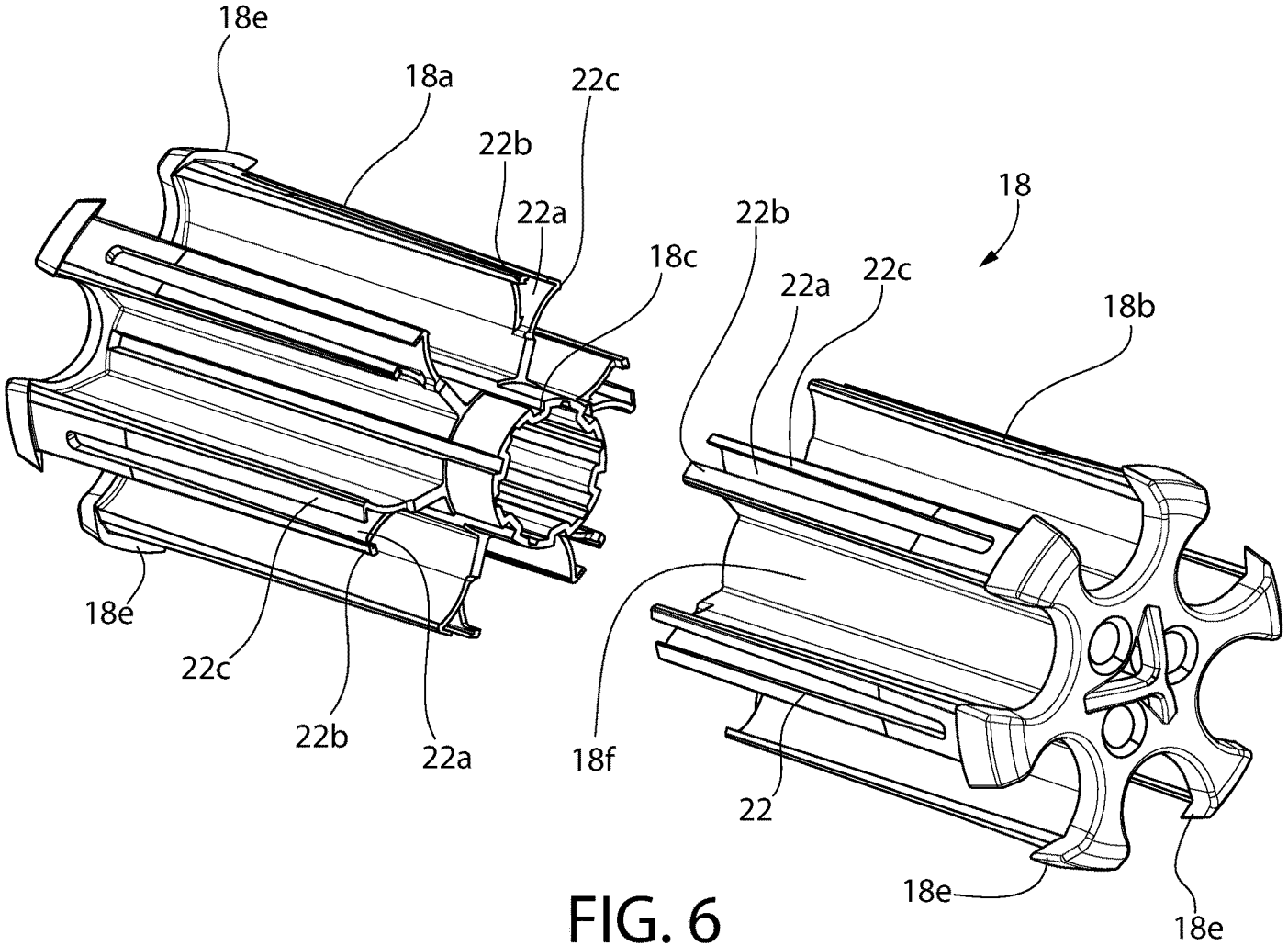
FIG. 6 is a perspective exploded view of the core of the shaft holding device of FIG. 1 shown with the outer sleeve removed.

Referring to FIG. 6, the core 18 may include a plurality of arms 22. Each arm 22 may extend longitudinally and project radially from the core 18 in between adjacent slots 14. Each arm 22 may include a split 22*a* splitting the arm 22 into two longitudinally extending and radially projecting fingers 22*b*, 22*c* allowing for the circumferential width $W_3$ (see FIG. 7) of each of the plurality of arms 22 to contract in the circumferential direction. Each arm 22 may have a generally Y-shaped cross section. In one embodiment, the fingers 22*b*, 22*c* extend circumferentially toward one another at each end to partially close the split 22*a*. In one embodiment, each arm 22 has a generally hollow end. In one embodiment, the fingers 22*b*, 22*c* form a hollow portion having a pie or triangular shaped cross section. The core 18 may have a generally cylindrical base 18*f* from which the arms 22 extend. In one embodiment, the base 18*f* is generally hollow.

In one embodiment, the outer sleeve 20, including the plurality of slots 14, is symmetrical about three planes $P_1$, $P_2$, $P_3$, each of the three planes $P_1$, $P_2$, $P_3$ being perpendicular to one another (see FIG. 2B). In one embodiment, the entire shaft holding device 10, except for the mounting features on each end, plurality of slots 14, is symmetrical about three planes $P_1$, $P_2$, $P_3$, each of the three planes $P_1$, $P_2$, $P_3$ being perpendicular to one another (see FIG. 2B).

Figure 7:
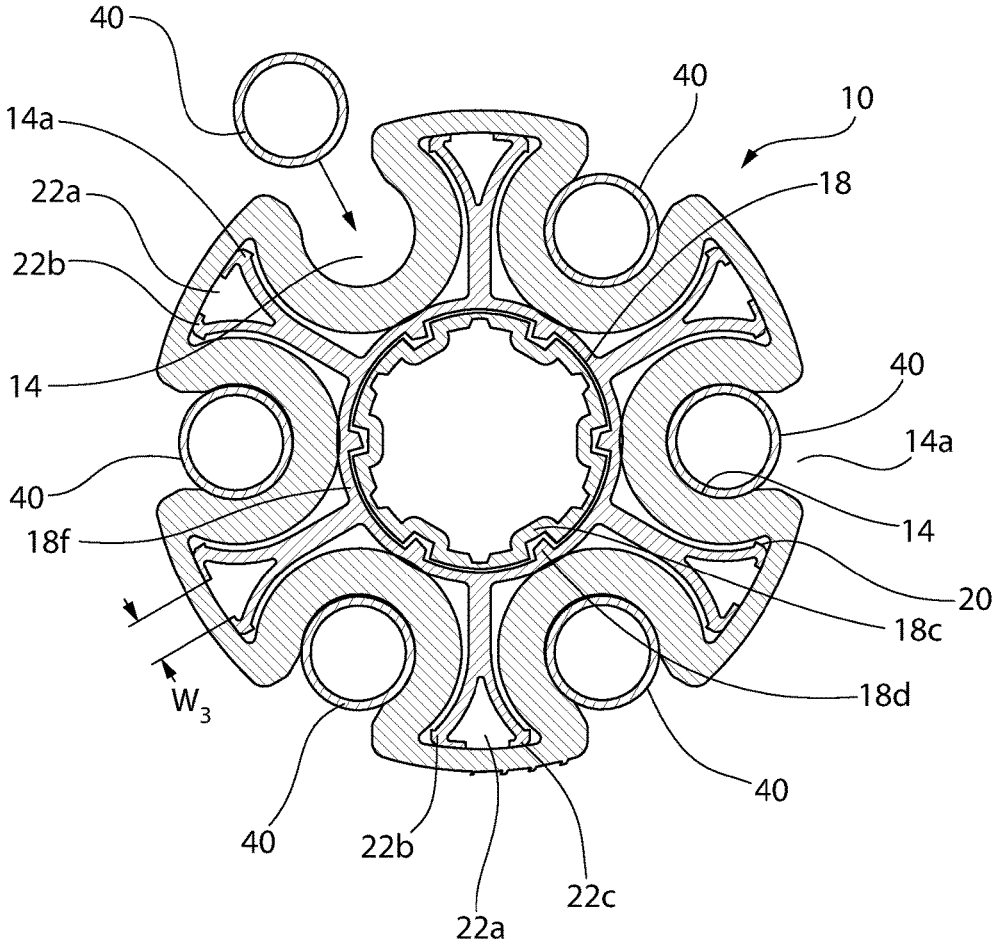
FIG. 7 is a cross sectional top view of the shaft holding device of FIG. 1 shown with 5 shafts inserted and one shaft removed.

Referring to FIG. 7, when inserting a shaft 40 into a slot, the opening 14*a* is circumferentially expanded by the larger diameter of the shaft 40. As the opening 14*a* expands, the split fingers 22*b*, 22*c* of the arm 22 provides some resistance to the expansion but contract toward one another to allow for the expansion but with more resistance than if the arm 22 was not present. Once the shaft 40 is inserted into the slot, the arms 22 expand back toward their initial position and help retain the shaft 40 in the slot 14. In one embodiment, because of the balance between the support of the internal fingers 22*b*, 22*c* and the flexibility of the elastomeric outer sleeve 20, the shaft holding device 10 is able to hold most shafts 40 with enough exit force to prevent the shafts 40 from falling out due to their own weight or minor bumps. Because the slots 14 are isolated from each other by way of the rigid arms 22 of the core 18, each slot has a generally consistent entry/exit force for the user, within a certain tolerance regardless of how many slots 14 contain shafts 40. If the arms 22 and the gaps between adjacent slots were omitted, the last shaft 40 inserted into the shaft holding device 10 may have a much higher entry/exit force than the first shaft 40 that was inserted into the shaft holding device 10. The gaps between adjacent slots 14 may allow for a large variety of shaft diameters. The slot 14 may secure shafts 40 having diameters that vary less than 0.5 inches from one another. In one embodiment, the slot 14 secures shafts 40 having diameters that vary less than 0.4 inches from one another.

The body 12 may be formed from any suitable material, and by any suitable manufacturing process. For example, shaft holding devices 10 described herein could be made with materials such as rubber, plastic, or other moldable material. In one embodiment, the shaft holding device 10 may be manufactured as a two piece mold, with additional processes performed to assembly the core 18 and add some of the mounting features described below. Exemplary manufacturing processes include, but are not limited to, injection molding, co-molding or over-molding, compression molding, and extrusion or co-extrusion.

The body 12 may include one or more mounts for attaching accessories to the shaft holding device 10. Because the shaft holding device 10 may be used in place of or away from a golf bag, having mounts, pockets and attachments may be useful to carry certain accessories.

Figure 8:
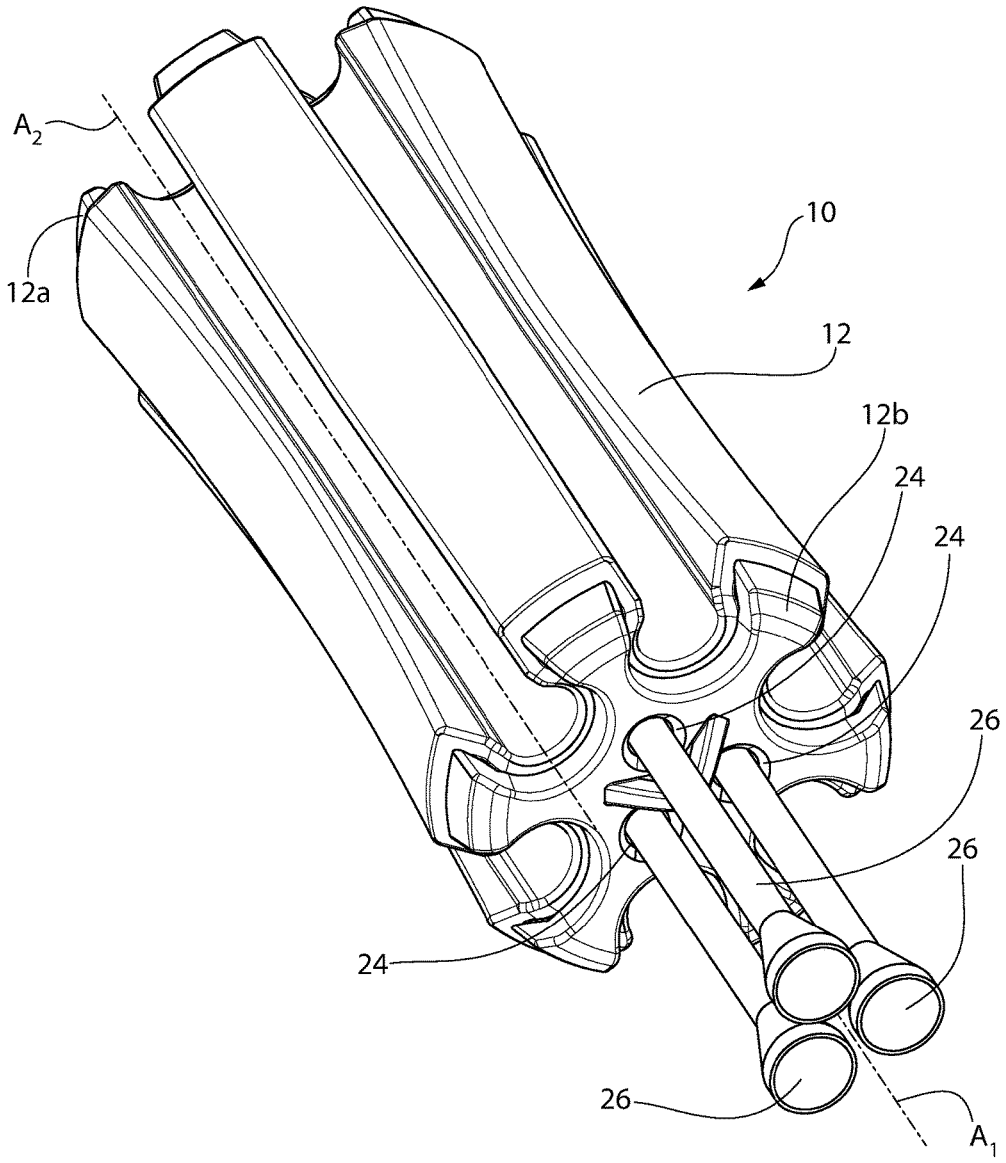
FIG. 8 is a bottom perspective view of the shaft holding device of FIG. 1 shown with a plurality of golf tees mounted in the bottom.

Referring to FIG. 8, the body 12 may include at least one aperture 24 extending through the bottom. The apertures 24 may be positioned radially closer to the central axis $A_1$ than each of the plurality of slots 14. In one embodiment, each aperture 24 is configured to releasably retain a golf tee 26. The golf tees 26 may releasably mount into the slots 24 by a press fit. The apertures 24 may include one or more longitudinally extending and radially projecting compressible ridges 24*a* to help in retaining the golf tee 26 (see FIG. 2H). In one embodiment, three apertures 24 are provided and are generally spaced around the central axis $A_1$.

Figure 9A:
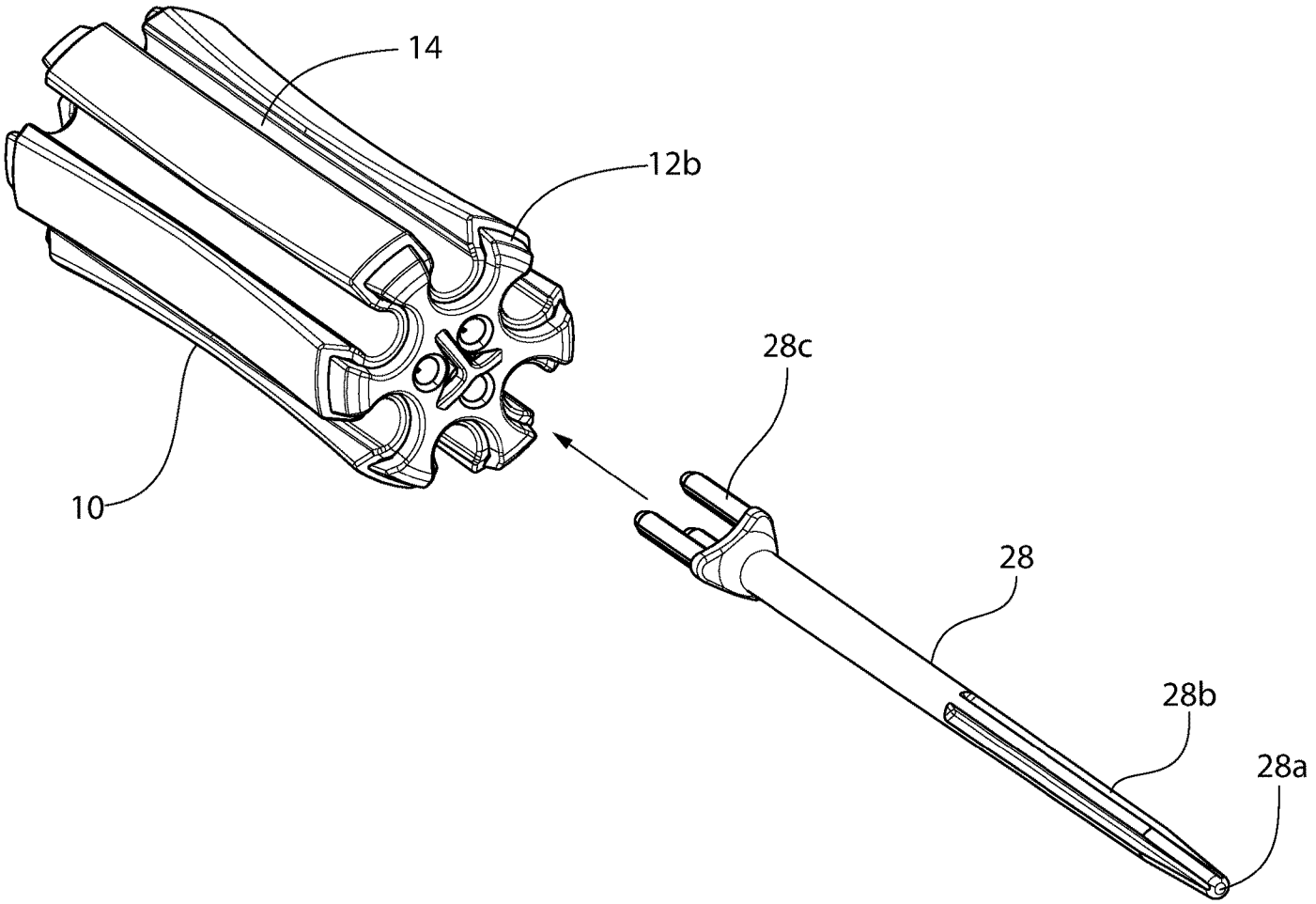
FIGS. 9A and 9B are perspective views of the shaft holding device of FIG. 1 shown with a spike in the detached and attached positions respectively.
Figure 9B:
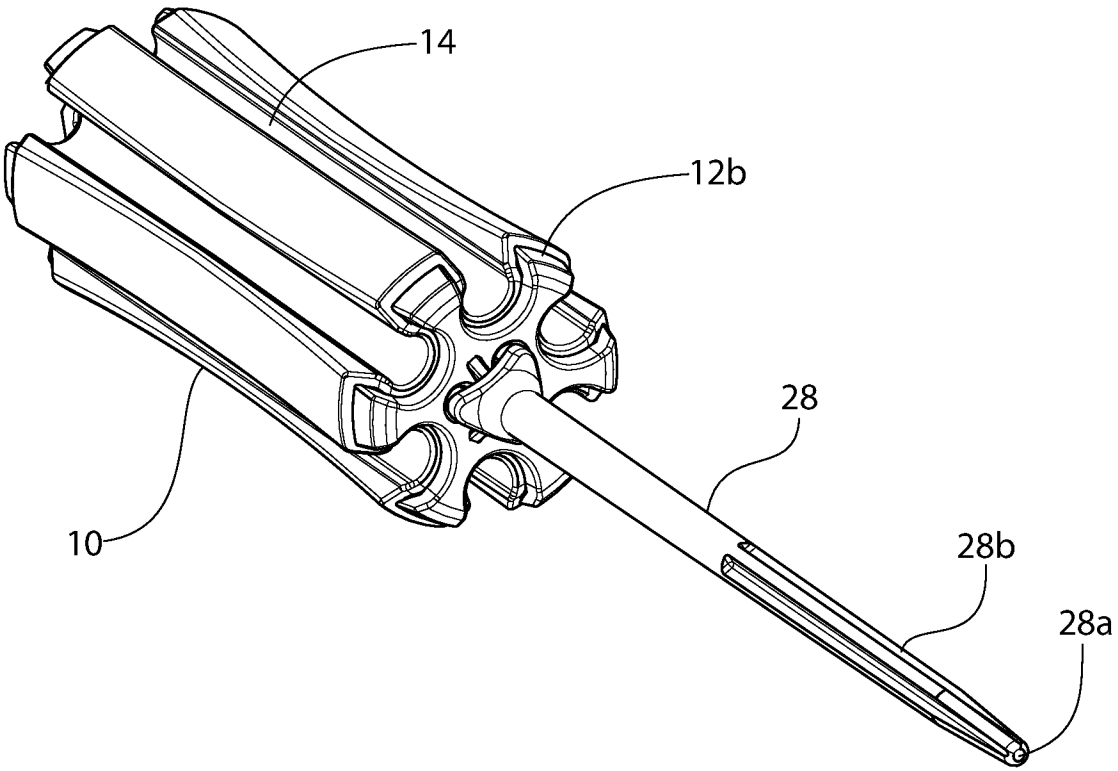

Referring to FIGS. 9A-9B, an attachment spike 28 may be provided. The spike 28 may include one or more prongs or projections 28*c* sized and configured to be releasably press fit into the apertures 24. In one embodiment, the spike 28 includes three generally equally spaced projections 28*c*. The spike 28 may have a blunt point 28*a* for inserting into the ground and support the shaft holding device 10 generally perpendicular to a ground surface G (see FIG. 1). The spike 28 may include a plurality of grooves 28*b*. The grooves 28*b* may help keep the spike 28 vertical in ground and reduce the amount of material needed saving weight. In one embodiment the spike 28 is about 6 inches to about 12 inches long. The body of the spike 28 may be configured to mount to the shaft holding device 10 using one of the slots 14 when the spike 28 is not being used. Though the shaft holding device 10 may be self-supported, particularly if three or more club heads 40*a* are used to help balance the assembly and provide at least a tri-pod base, the spike 28 may provide additional support in windy conditions, uneven surfaces, and/or where the club heads 40*a* do not provide for an even base (e.g., using only two clubs). Keeping the shafts 40 vertical may help locate the clubs and to prevent the grips 40*b* from getting dirty or wet. In one embodiment, the user may flip the shaft holding device 10 relative to the clubs with the spike mounted on the bottom 12*b* when transporting the assembly so that the spike 28 extends between the shafts 20.

Figure 2I:
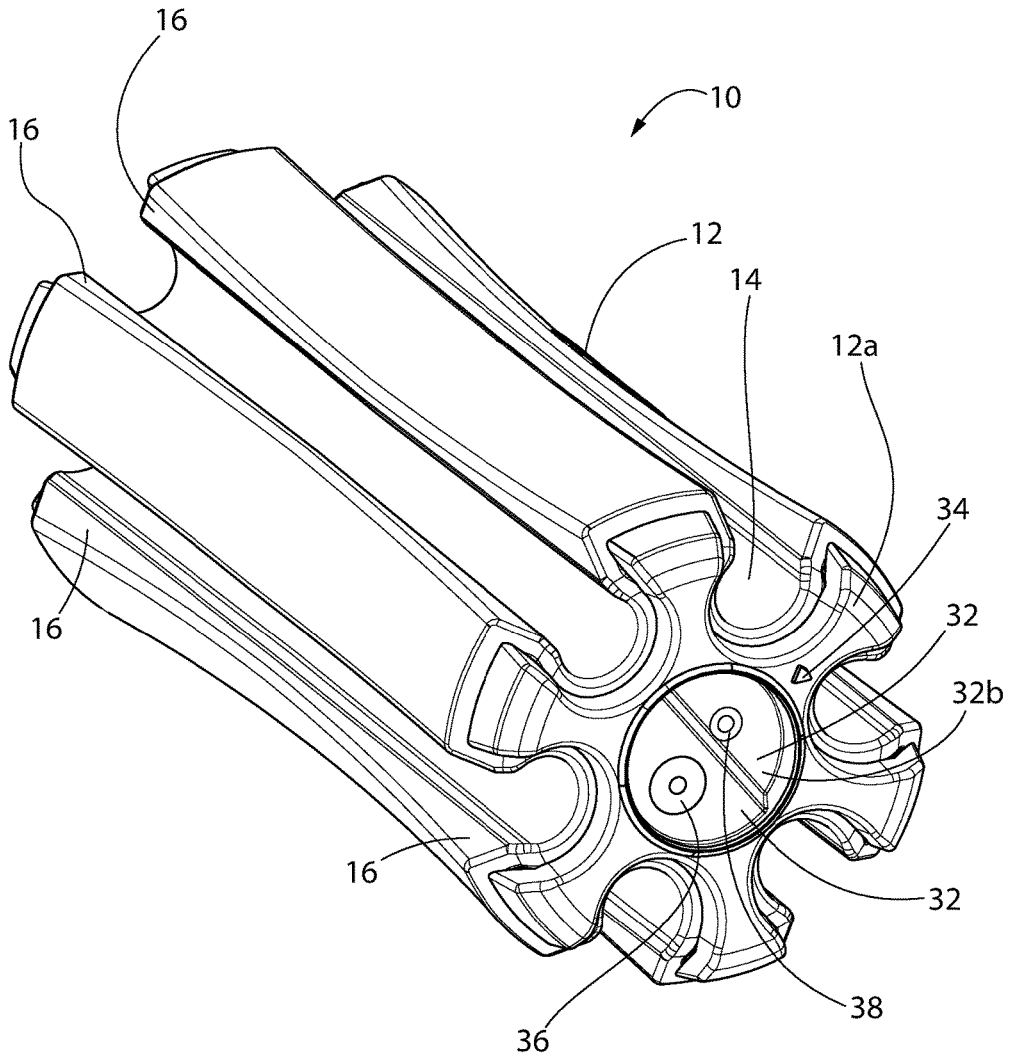
FIG. 2I is a top perspective view of the shaft holding device of FIG. 1 with the ball marker removed.

Referring to FIGS. 2A and 2I, the shaft holding device 10 may include a golf ball marker 30 releasably attached to the body 12. The body 12 may include a recess 32 generally sized to accept the golf ball marker 30. The recess 32 may include a mount surface 32*b* and a further recessed surface 32*b*. The mount surface 32*b* may include a magnet 36 that retains the golf ball marker 30 to the body 12. The further recessed surface 32*b* may be set into the body further longitudinally than the mount surface 32*b* such that the golf ball marker 30 may be released from the magnet 36 by pressing on the golf ball marker 30 in the area of the golf ball marker 30 extending over the further recessed surface 32*b*. Pressing on the golf ball marker 30 in the area of the golf ball marker 30 extending of the further recessed surface 32*b* may cause the golf ball marker 30 to pivot releasing the golf ball marker 30 from the magnet and allow the user to grasp an edge of the golf ball marker 30. The body 12 may include indicia 34 proximate the further recessed surface 32*b* to indicate to the user where the golf ball marker 30 should be pressed in order to release it from the magnet 36. The further recessed surface 32*b* may include a mount 38 such as a threaded insert for mounting additional accessories to the body 12 as discussed below.

Figure 10:
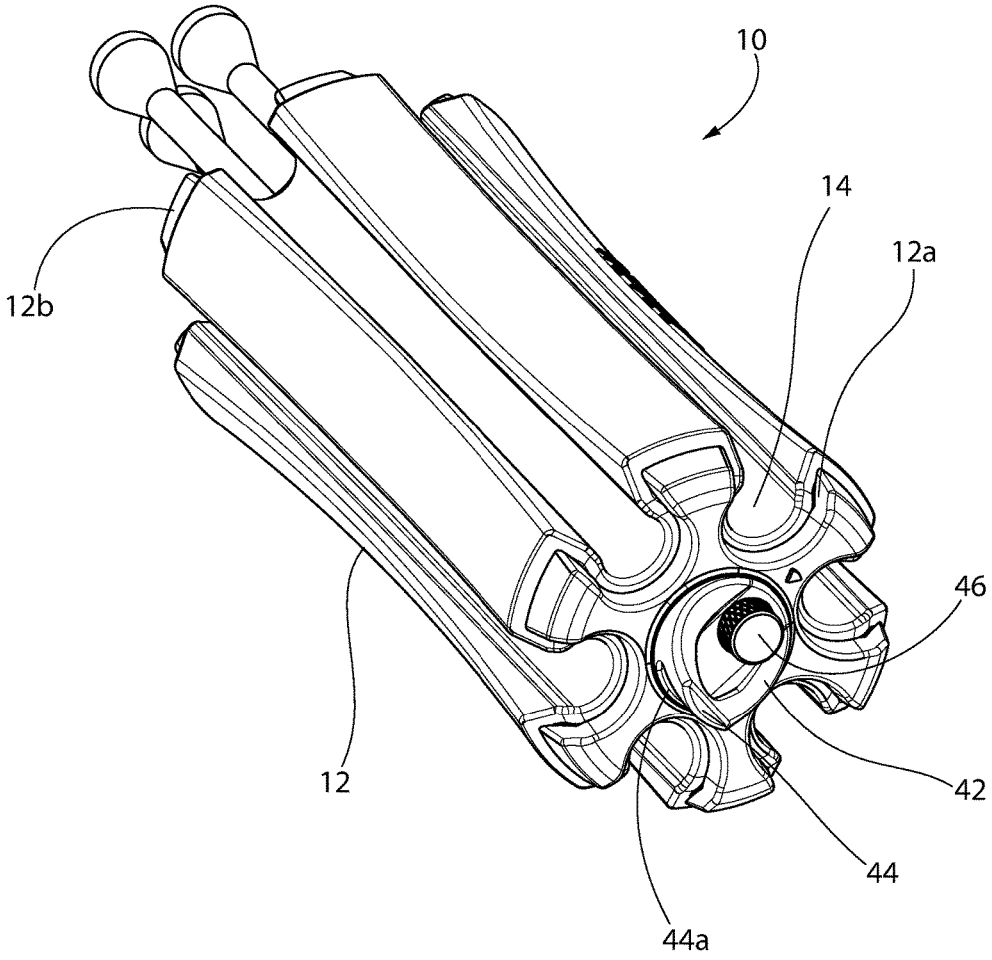
FIG. 10 is a top perspective view of the shaft holding device of FIG. 1 shown with the ball marker removed and the attachment adapter attached.

Referring to FIG. 10, a strap mount 42 may be coupled to the body 12. In one embodiment, the strap mount 42 is releasably mounted to the body 12. The strap mount 42 may include a hook or loop 44 with an opening 44*a* configured to receive a carrying strap (see FIGS. 11A-12B) for carrying or hanging the shaft holding device 10. The strap mount 42 may include a fastener 46 for coupled with the mount 38 (see FIG. 2I). In one embodiment, the fastener 46 includes a thread that engages with a corresponding thread of the mount 38.

Figure 11A:
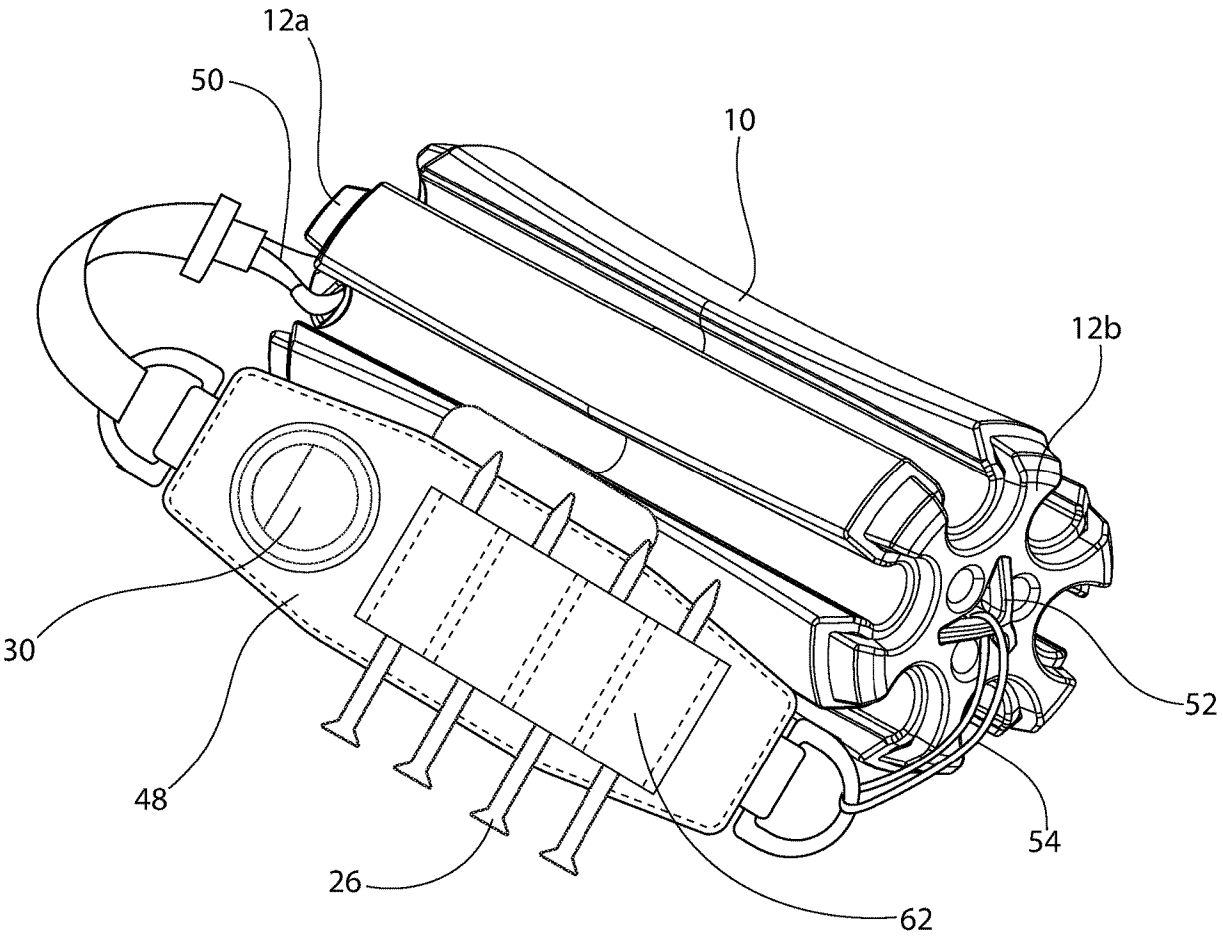
FIGS. 11A and 11B are bottom and top perspective views respectively of the shaft holding device of FIG. 1 shown with a hand strap attached to each end.
Figure 11B:
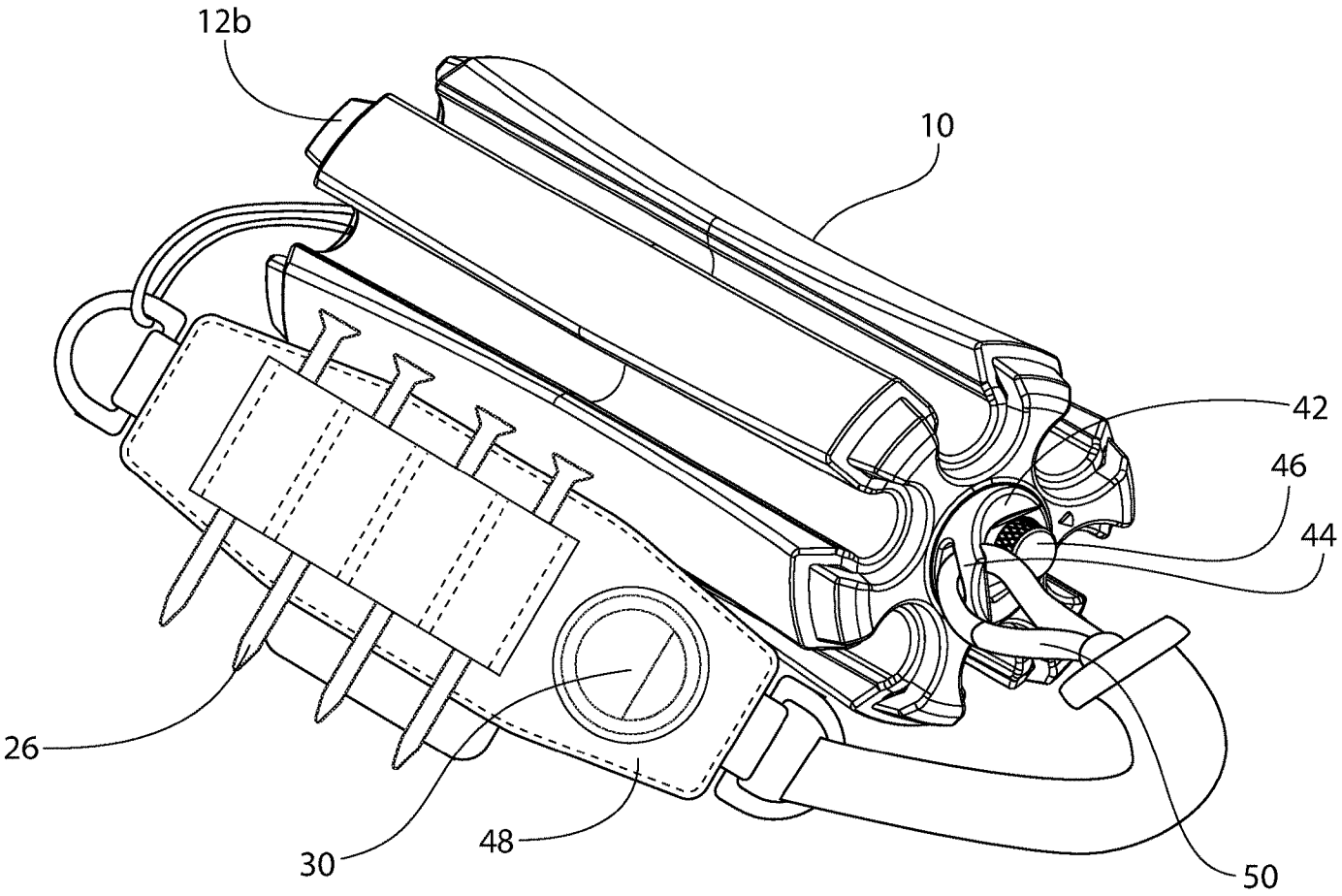

Referring to FIGS. 11A and 11B, a hand strap 48 is shown coupled to the shaft holding device 10. The hand strap 48 may releasably couple to a top 12*a* of the body 12 by attaching to the strap mount 42. In one embodiment, the hand strap 48 attaches to the strap mount 42 through a clip 50. The hand strap 48 may releasably couple to a bottom 12*b* of the body 12 by attaching to a hook or loop 52 extending from the bottom 12*b* of the body 12. In one embodiment, the hook or loop 52 is a projection having one or more openings. The hand strap 48 may be attached to the hook or loop 52 using a tie 54. The tie 54 may be tied or looped to the hook or loop 52. In other embodiments, the hand strap 48 is attached to the bottom 12*b* of the body 12 using a clip similar to clip 50 above. The hand strap 48 may extend from the top 12*a* of the body 12 to the bottom 12*b* of the body 12 and extend over the back of the user's hand to provide further support of the user's hand while carrying the shaft holding device 10. The length of the hand strap 48 may be adjustable. The hand strap 48 may include pockets and mounts 62 for attaching accessories such as golf tees 26 and ball markers 30.

Figure 12A:
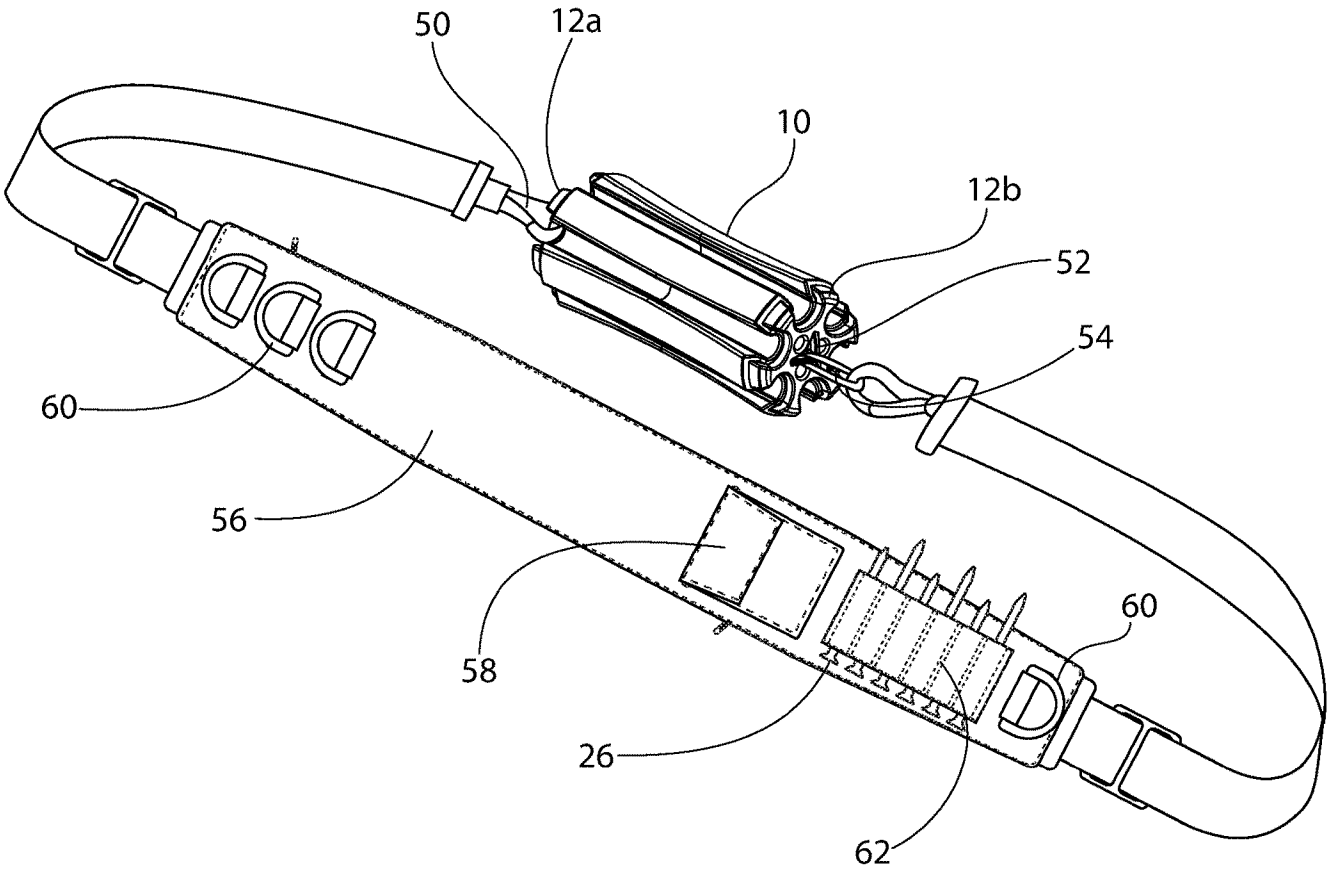
FIGS. 12A and 12B are bottom top perspective views respectively of the shaft holding device of FIG. 1 shown with a shoulder strap attached to each end.
Figure 12B:
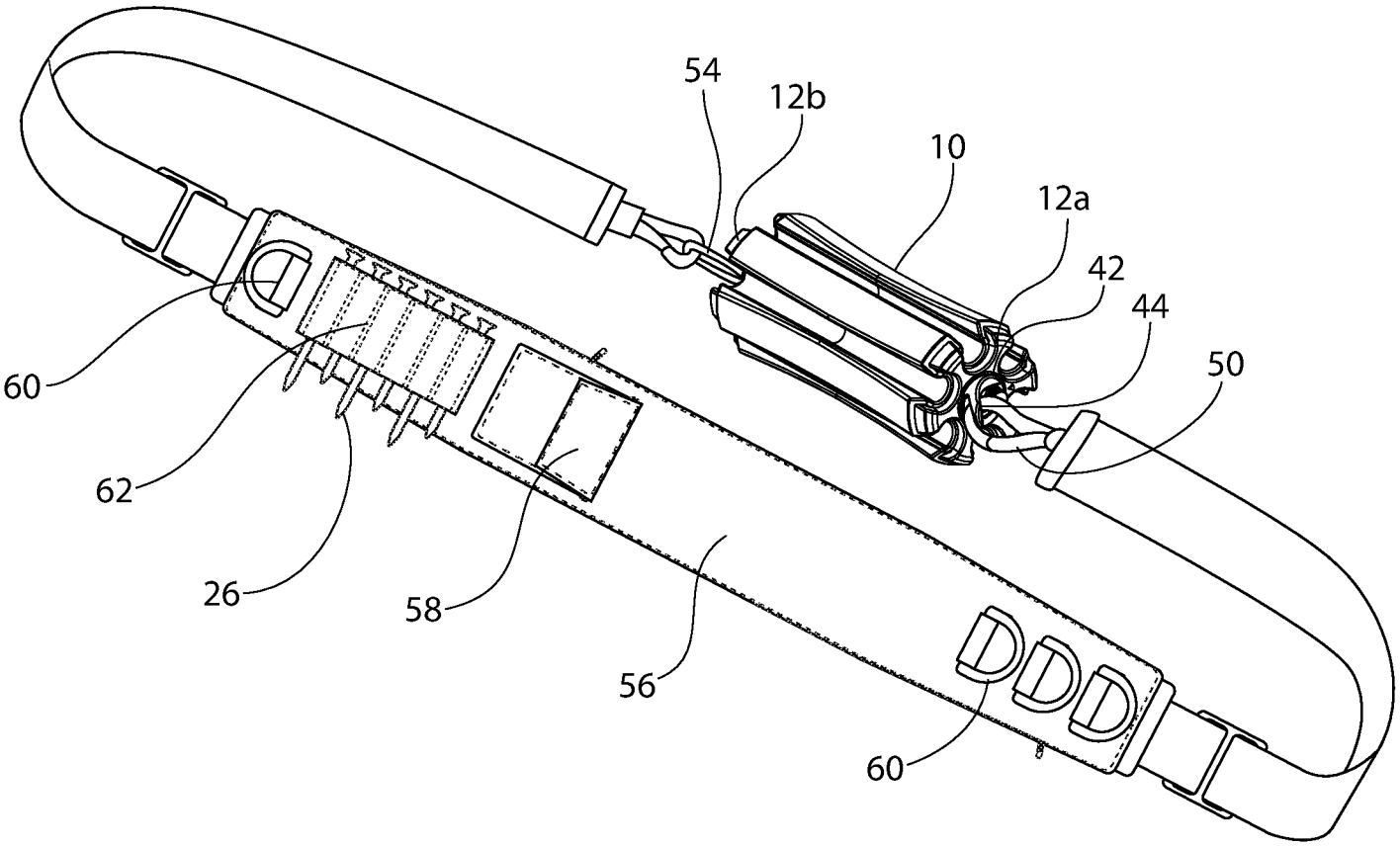

Referring to FIGS. 12A and 12B, a shoulder strap 56 is shown coupled to the shaft holding device 10. The shoulder strap 56 may releasably couple to a top 12*a* of the body 12 by attaching to the strap mount 42. In one embodiment, the shoulder strap 54 attaches to the strap mount 42 through a clip 50. The shoulder strap 56 may releasably couple to a bottom 12*b* of the body 12 by attaching to a hook or loop 52 extending from the bottom 12*b* of the body 12. In one embodiment, the hook or loop 52 is a projection having one or more openings. The shoulder strap 56 may be attached to the hook or loop 52 using a tie 54. The tie 54 may be tied or looped to the hook or loop 52. In other embodiments, the shoulder strap 56 is attached to the bottom 12*b* of the body 12 using a clip similar to clip 50 above. The shoulder strap 56 may extend from the top 12*a* of the body 12 to the bottom 12*b* of the body 12 and extend over a user's shoulder to allow the shaft holding device to be carried similar to a traditional golf bag. The length of the shoulder strap 56 may be adjustable. The shoulder strap 56 may include one or more pockets 58, rings 60 or mounts 62 for containing and attaching or containing accessories such as golf gloves, towels, hats, golf balls, phones, wallet, keys, golf tees 26 and ball markers 30.

Figure 13A:
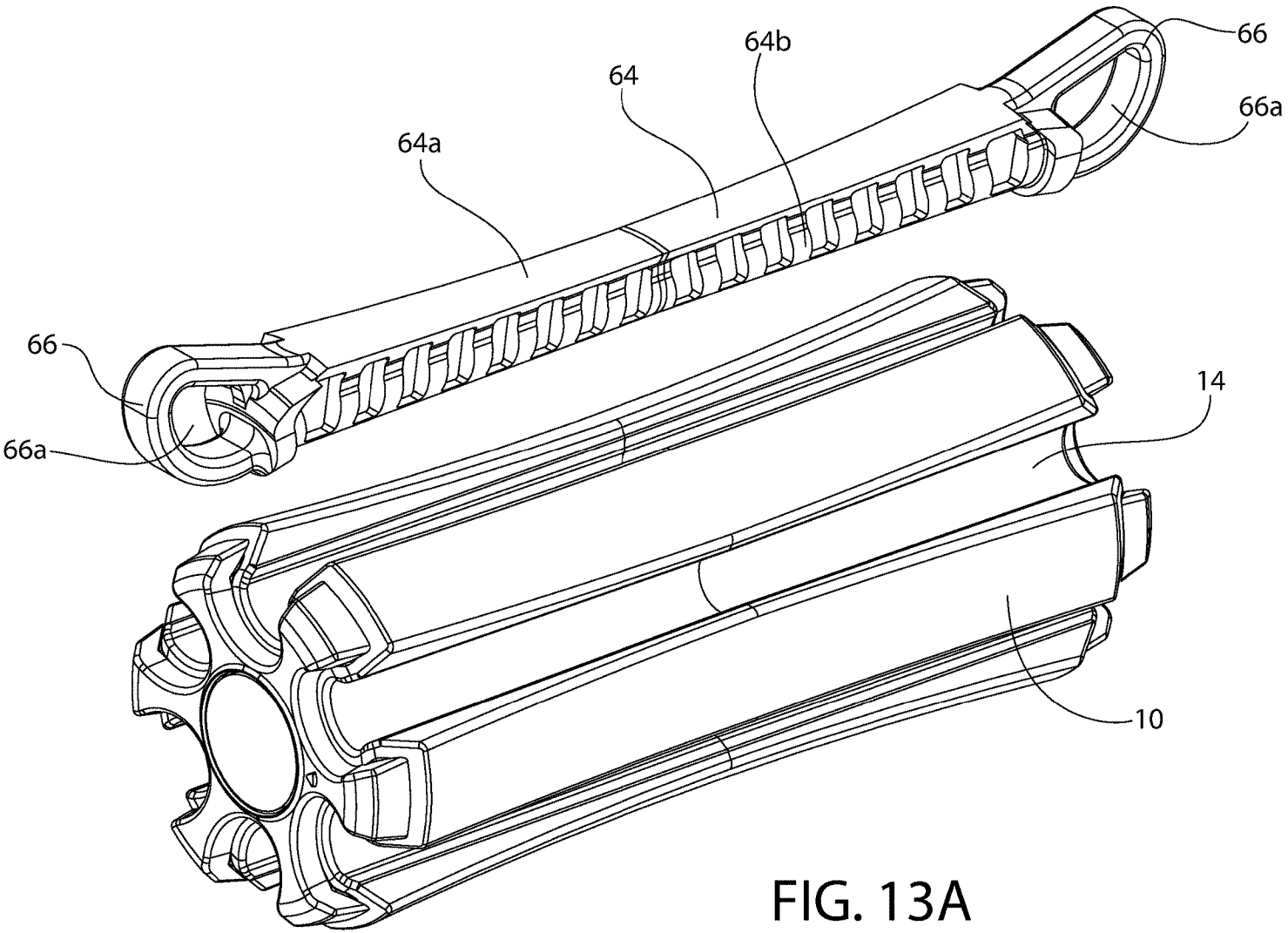
FIGS. 13A and 13B are perspective views of the shaft holding device of FIG. 1 shown with a shoulder strap mount accessory in the detached and attached positions respectively.
Figure 13B:
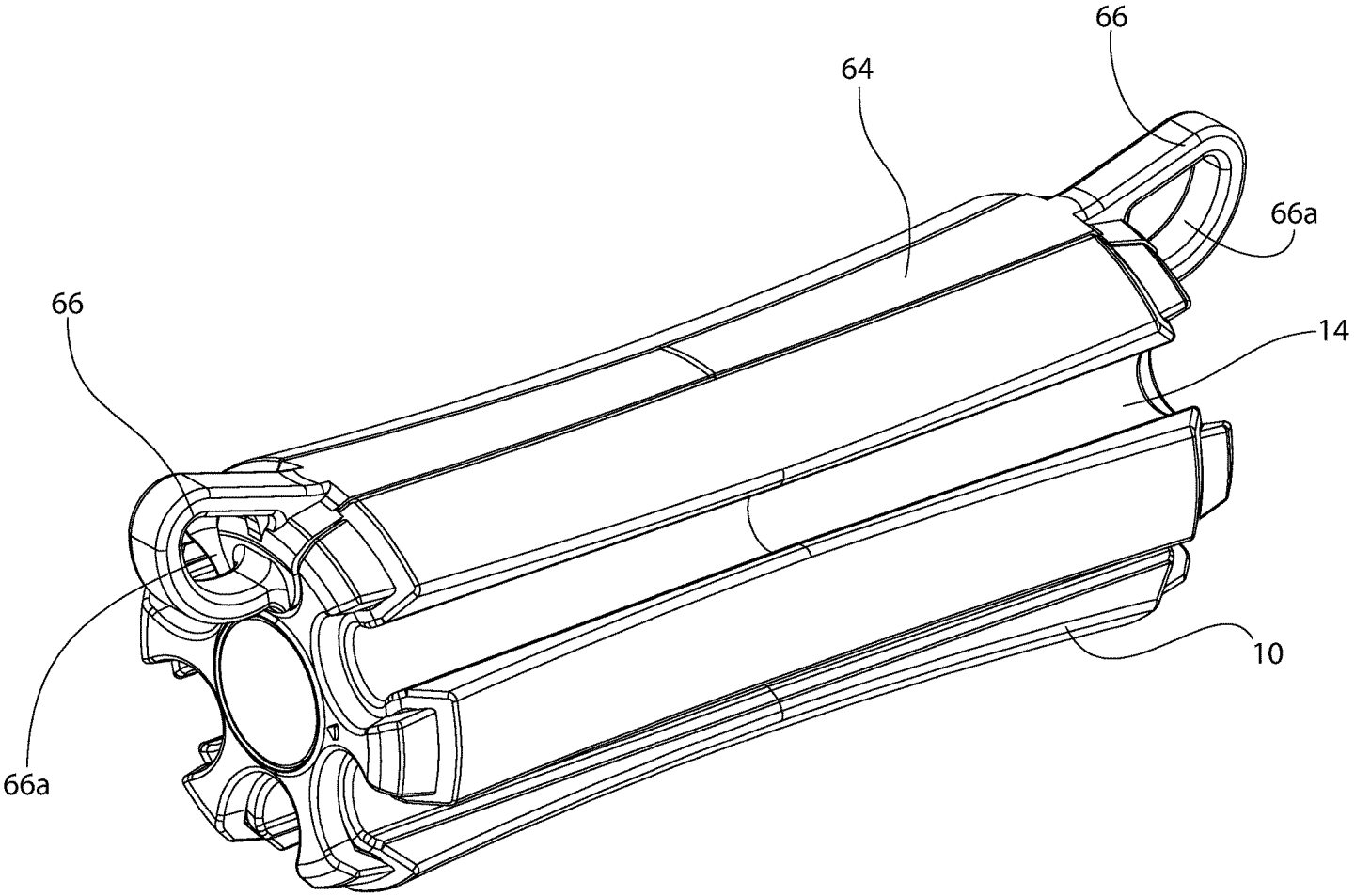
Figure 14B:
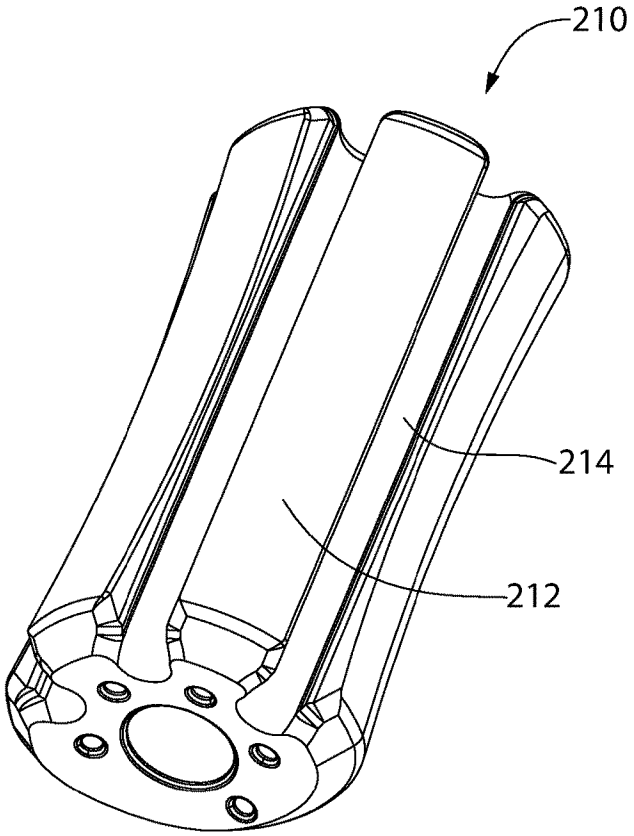
FIGS. 14A-14H are bottom front perspective, bottom rear perspective, left side, rear, right side, front, top and bottom views respectively of a shaft holding device according to another exemplary embodiment of the present invention.
Figure 14A:
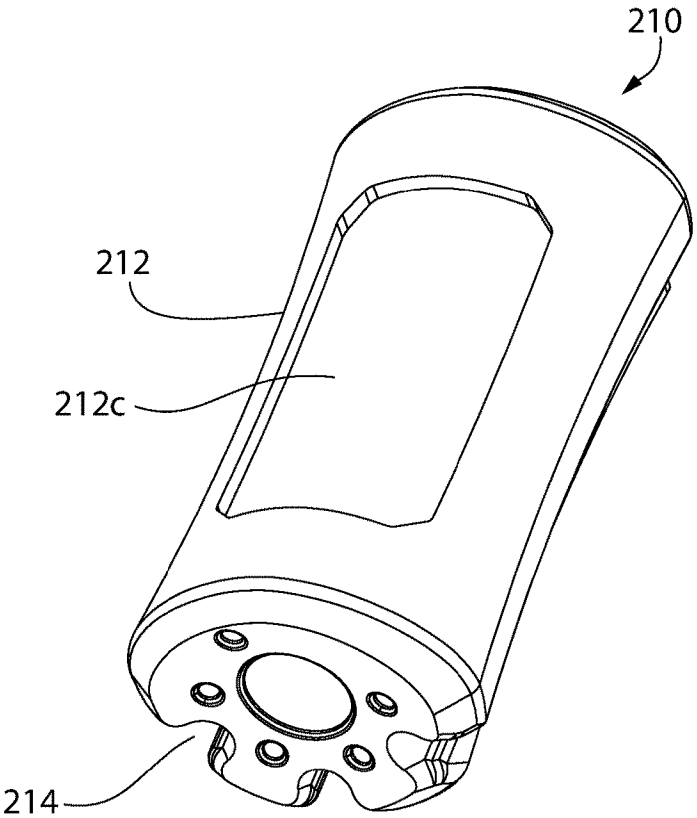
Figures 14C, 14D, 14E, 14F:
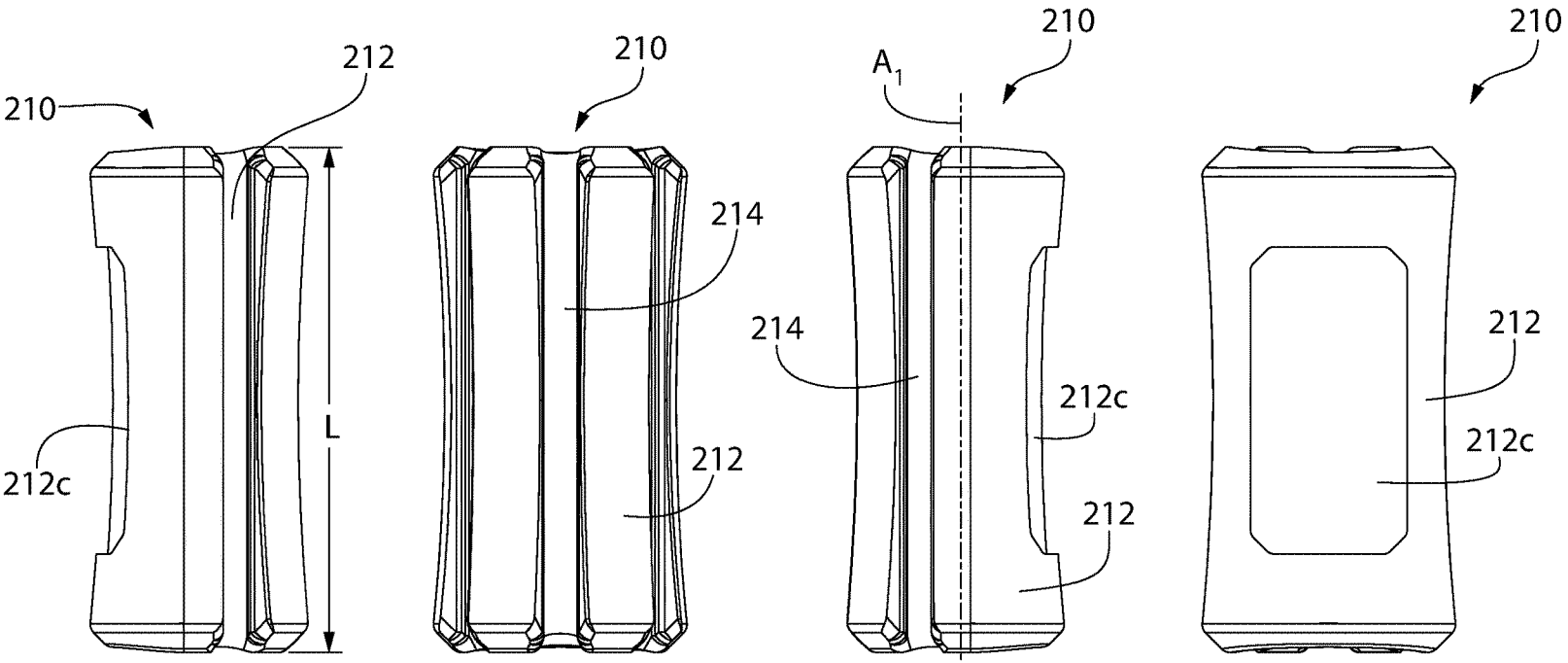
Figure 14G:
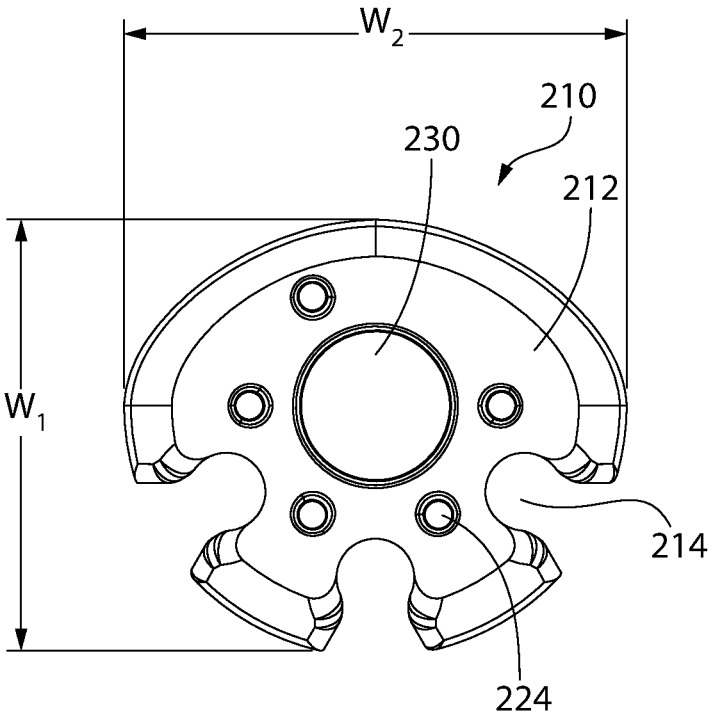
Figure 14H:
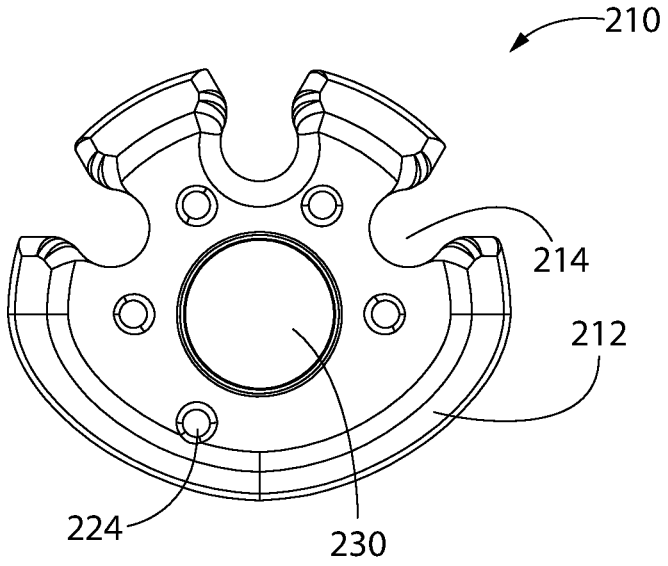

Referring to FIGS. 13A and 13B a strap mounting accessory 64 may be provided for use with the shaft holding device 10. The strap mounting accessory 64 may quickly and easily be mounted into one of the slots 14 to provide a carrying handle or strap for the shaft holding device 10. The strap mounting accessory 64 may include one or more loops 66 forming an opening 66*a* for receiving a strap such as the hand strap 48 or shoulder strap 56 discussed above. The strap mounting accessory 64 may include an elongated body 64*a* that is generally the same shape as the slots 14. In one embodiment, the body 64*a* is slightly radially larger than a slot 14 such that the body 64*a* is snugly retained in the slot 14. When inserted in an aperture 14, the body 64*a* of the strap mounting accessory 64 may be generally flush with the body 12 of the shaft holding device 10. The strap mounting accessory 64 may include a plurality of circumferentially extending and radially projecting ribs 64*b*. The ribs 64*b* may help to decrease the amount of material needed and make the body 64*a* lighter while maintaining radial strength. The body 64*a* may be generally hollow to decrease the amount of material needed and make the body 64*a* lighter. In other embodiment, the strap mounting accessory 64 includes or forms a handle for carrying the shaft holding device 10. In other embodiments, a handle or strap is attached or extends from the side of the body 12.

In another embodiment, a stand mount (not shown) may be provided that similarly mounts to the shaft holding device 10 but extends radially outwardly more than a length of a club head toward an end of the body 12 for providing a stand to keep the club heads off of the ground when the shaft holding device 10 is paced down generally horizontal. Such a stand may be preferred in situations where standing up the shaft holding device 10 vertically is not practical or desired.

Referring to the drawings in detail, wherein like reference numerals indicate like elements throughout, there is shown in FIGS. 14A-20B a shaft holding device, generally designated 210, 310, 410, 510, 610, 710, 810, second, third, fourth, fifth, sixth, seventh and eighth exemplary embodiments of the present invention respectively. Various embodiments of the shaft holding devices 210, 310, 410, 510, 610, 710, 810 are described in further detail below in reference to the exemplary embodiments shown in the figures. One or more of the embodiments discussed in reference to the shaft holding devices 210, 310, 410, 510, 610, 710, 810 described below may be combined with one or more desirable features of the embodiments discussed in reference to the other shaft holding devices 10, 210, 310, 410, 510, 610, 710, 810 described herein.

Referring to FIGS. 14A-14H, the shaft holding device 210 may be asymmetrical relative to the central axis such that two or more (e.g. three) of the slots 214 are provided primarily toward one side of the body 212. In one embodiment, the other side of the body 212 may be generally free of slots 214. In one embodiment, one side of the body 212 may include indicia 212*c* such as a logo, message, initials, and/or picture allowing for customization, promotion, and/or decoration. In one embodiment, the indicia 212*c* recessed into the body 212 to allow for the indicia 212*c* that is coupled to the body 212 to be generally flush with the body 212. In one embodiment, the side of the body 212 may be configured to retain a score card or include a reusable scorecard with rotatable or digital numbering.

The cross sectional shape of the body 212 taken perpendicular to the central axis $A_1$ may be asymmetrical such that a first width $W_1$ may be smaller than a second width $W_2$ taken generally perpendicular to first width $W_1$. In one embodiment, width $W_1$ is approximately 2.25 inches. In one embodiment, width $W_2$ is approximately 2.0 inches. In one embodiment, the length L of the shaft holding device 210 is approximately 4.3 inches.

Figure 15A:
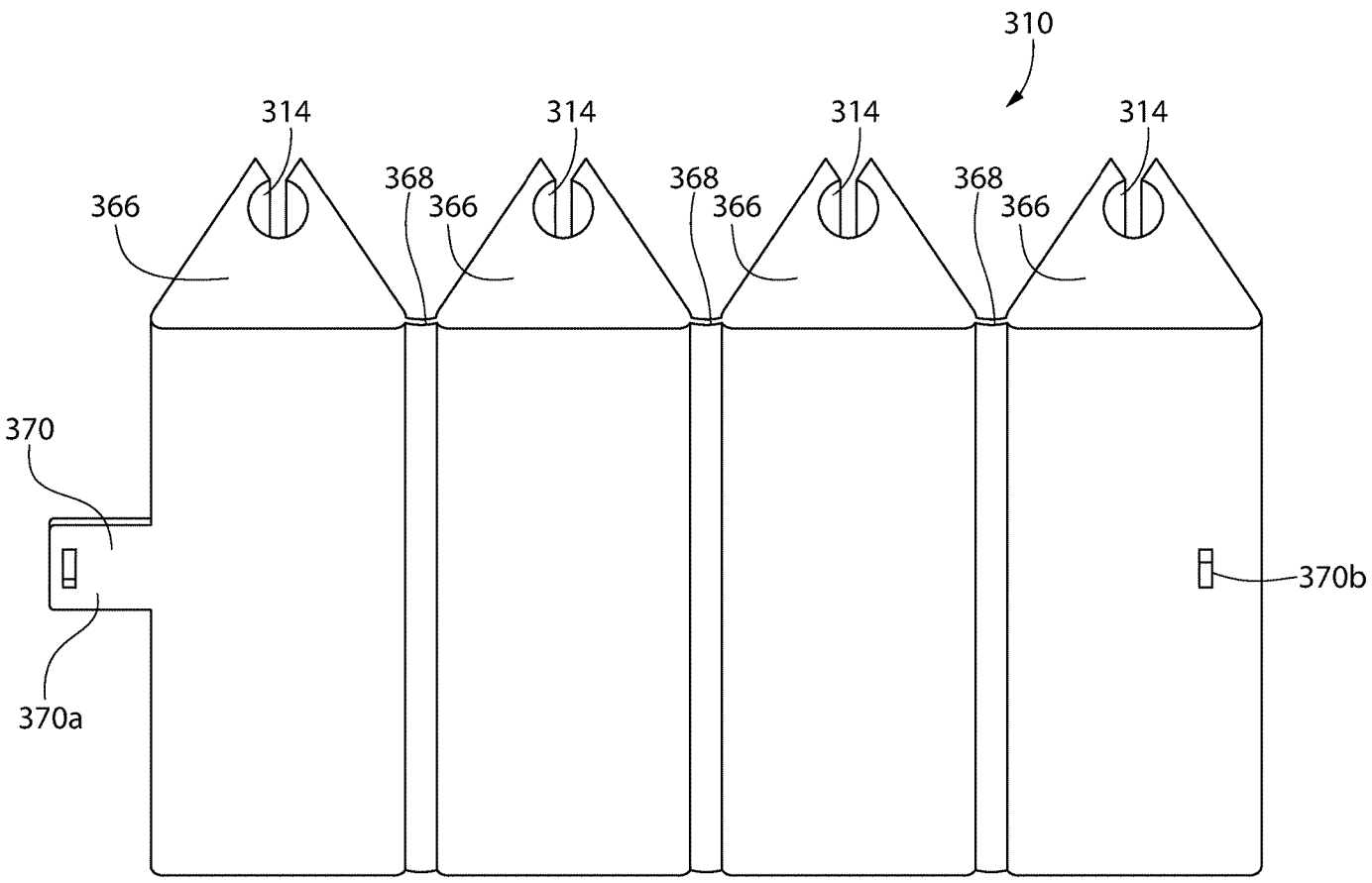
FIGS. 15A and 15B are perspective views of a shaft holding device according to another exemplary embodiment of the present invention shown in open and closed positions respectively.
Figure 15B:
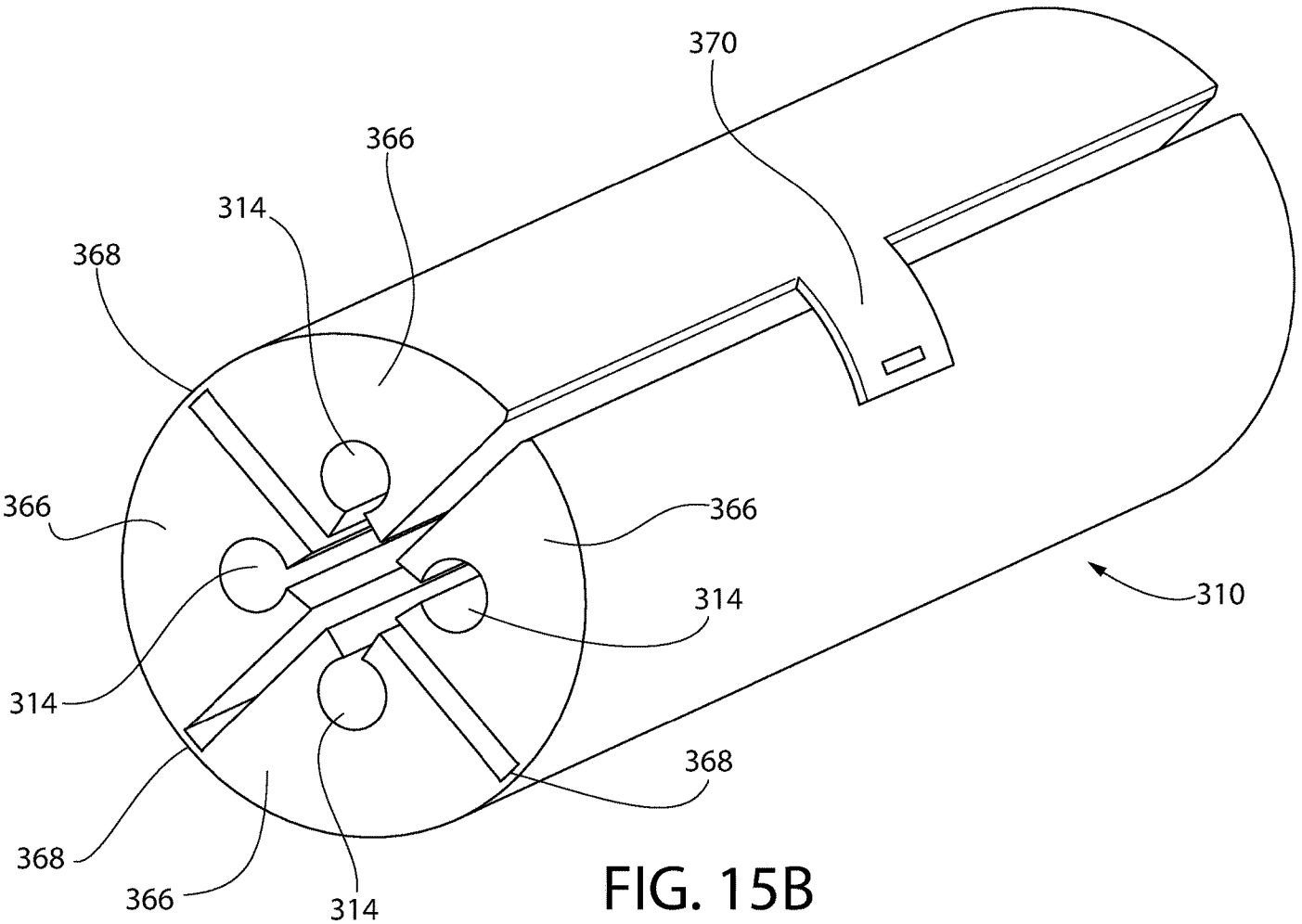

Referring to FIGS. 15A and 15B, a shaft holding device 310 is shown in the open and closed position respectively. While shaft holder devices 10 having slots 14 that are open outwardly have been shown and described above, shaft holding device 310 includes radially inwardly opened slots 314 to retain a shaft 40 in a similar manner as discussed above. The body 312 of the shaft holding device 310 includes a plurality of segments 366 attached via living hinges 368. Segments 366 may be shaped such that the shaft holding device 210 may be "rolled up" about the central axis $A_1$ such that the body 312 wraps around the shafts further securing the shafts in the slots 314 during storage. In one embodiment, the segments 366 have a pie shaped or triangular cross section. Any number of segments 366 may be used, increasing or decreasing the number of shafts held by the shaft holding device 310 over the four segments 366 illustrated. A locking mechanism 370 such as a latch may be provided to secure the shaft holding device 310 in the closed position. The locking mechanism 370 may include a radially pivotable tab 370*a* that releasably couples to a lock 370*b*. In one embodiment, the locking mechanism 370 is a snap fit. In one embodiment, the locking mechanism 370 includes a magnet.

Figure 16B:
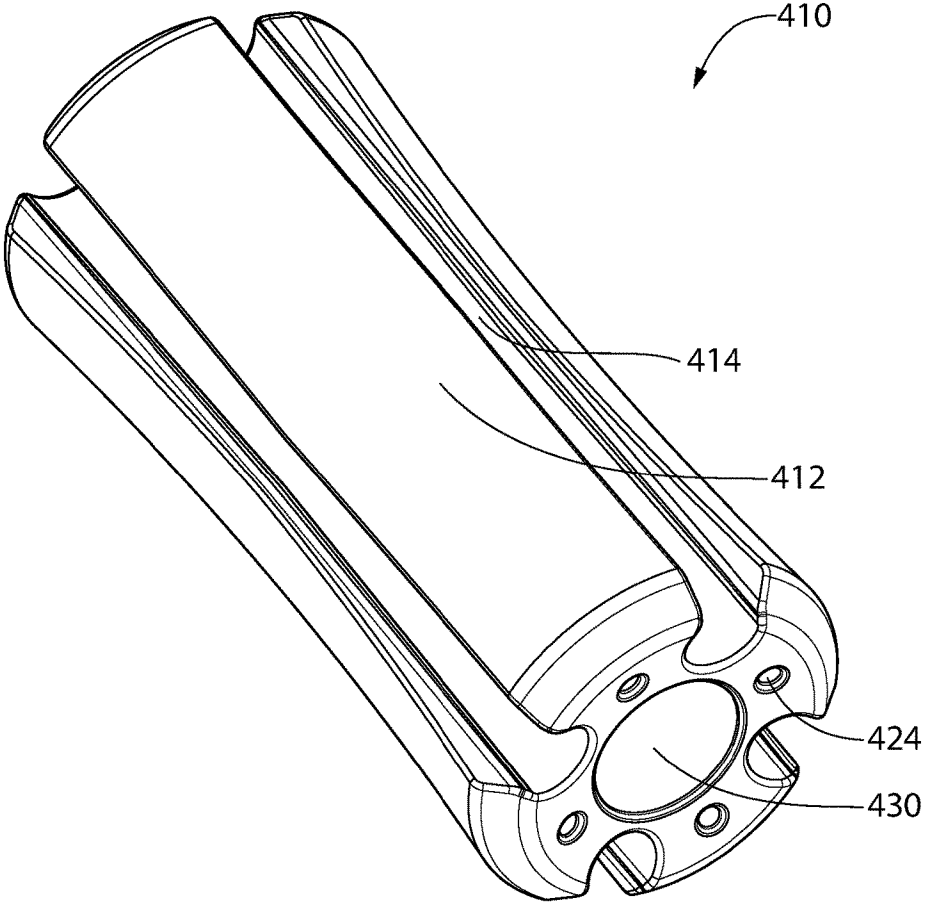
FIGS. 16A-16B are top and perspective respectively of a shaft holding device according to another exemplary embodiment of the present invention.
Figure 16A:
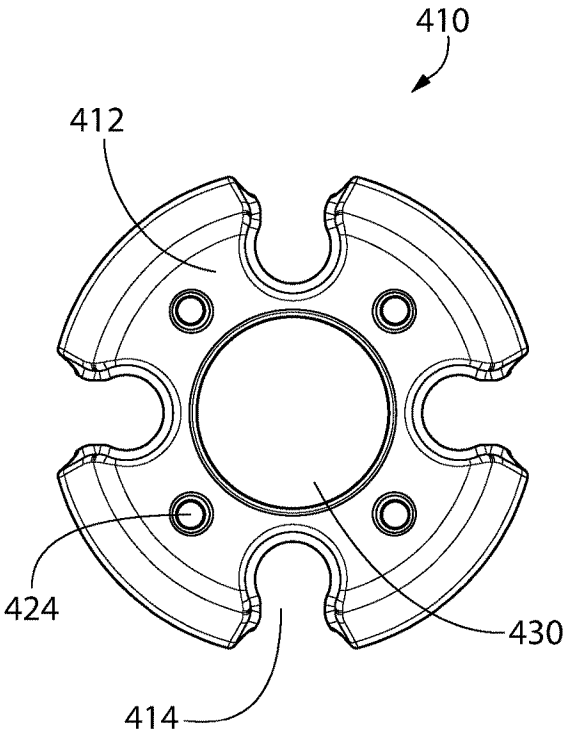

Referring to FIGS. 16A-16B, the shaft holding device 410 may be formed of a monolithic piece of material. In one embodiment, the shaft holding device 410 is comprised of silicone rubber. In one embodiment, the shaft holding device 410 has a durometer of approximately 40-60 A. In one embodiment, the shaft holding device 410 is solid except for mounting apertures 424, 430 formed in the top and/or bottom ends of the shaft holding device 410. In other embodiments, the shaft holding device 410 includes one or more internal open spaces. In one embodiment, the shaft holding device 410 include 4 slots 414. In other embodiments, the shaft holding device 410 includes 1, 2, 3, 5, 6, 7, 8 or more slots 414. The slots 414 may be grouped with two pairs of slots 14 closer to one another. In other embodiments, the slots 414 may be equally spaced around the perimeter of the shaft holding device 410 or all grouped toward one side.

Figure 17B:
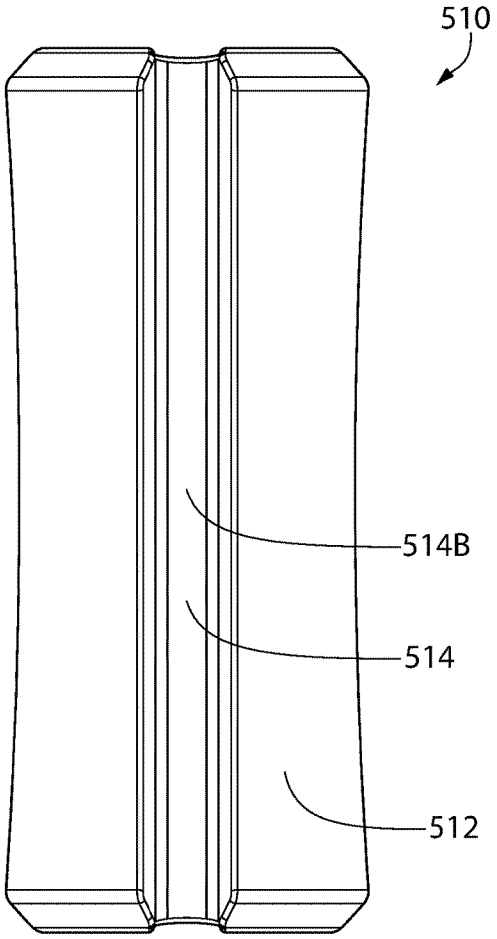
FIGS. 17A-17B are top and side views respectively of a shaft holding device according to another exemplary embodiment of the present invention.
Figure 17A:
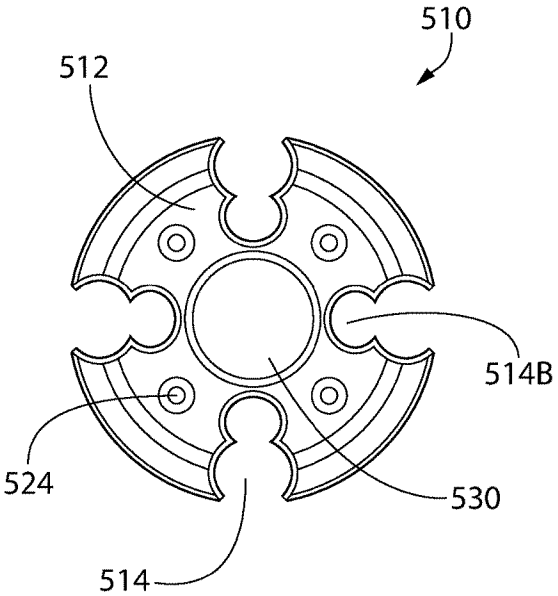

Referring to FIGS. 17A-17B, each slot 514 may include a further recess 514*b*. The recess 514*b* may be configured to help allow the corresponding slot 514 to flex circumferentially when inserting a shaft. The recess 514*b* may have a generally circular cross section. In other embodiments, the recess 514*b* has another cross-sectional shape such as square, rectangle, or triangle. In one embodiment, the diameter of recess 514*b* is smaller than the diameter of slot 514. The recess 514*b* may extend along the entire length of slot 514. In other embodiments, the recess 514*b* extends along only a portion of the length of the slot 514.

Figure 18B:
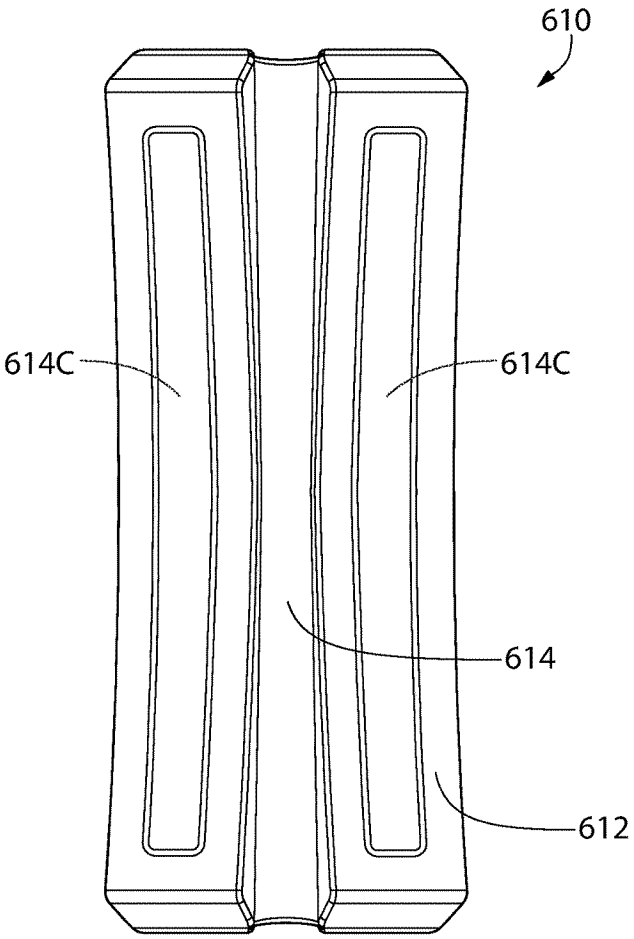
FIGS. 18A-18B are top and side views respectively of a shaft holding device according to another exemplary embodiment of the present invention.
Figure 18A:
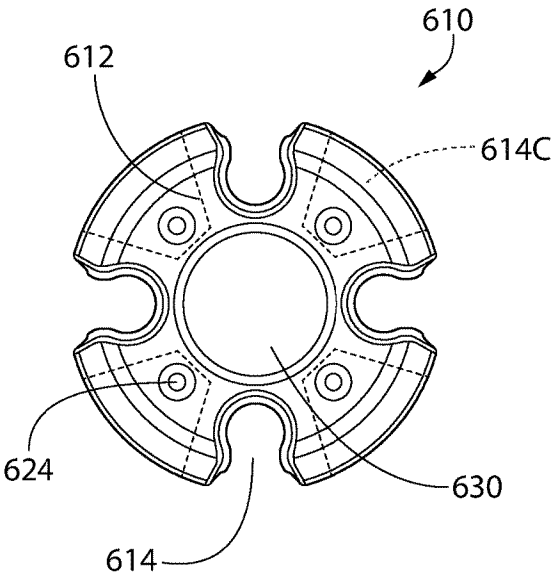

Referring to FIGS. 18A-18B, the body 612 may include a recess 614*c* extending longitudinally and projecting radially inwardly in a side of the body 612 between two adjacent slots 614. The recess 614*c* may be configured to help allow the corresponding slot 614 to flex circumferentially when inserting a shaft. The recess 614*c* may have a generally isosceles quadrilateral cross section. In other embodiments, the recess 514*b* has another cross-sectional shape such as square, rectangle, circular, or triangle. The recess 514*b* may extend substantially along the entire length of slot 514. In other embodiments, the recess 514*b* extends along only a portion of the length of the slot 514.

Figure 19B:
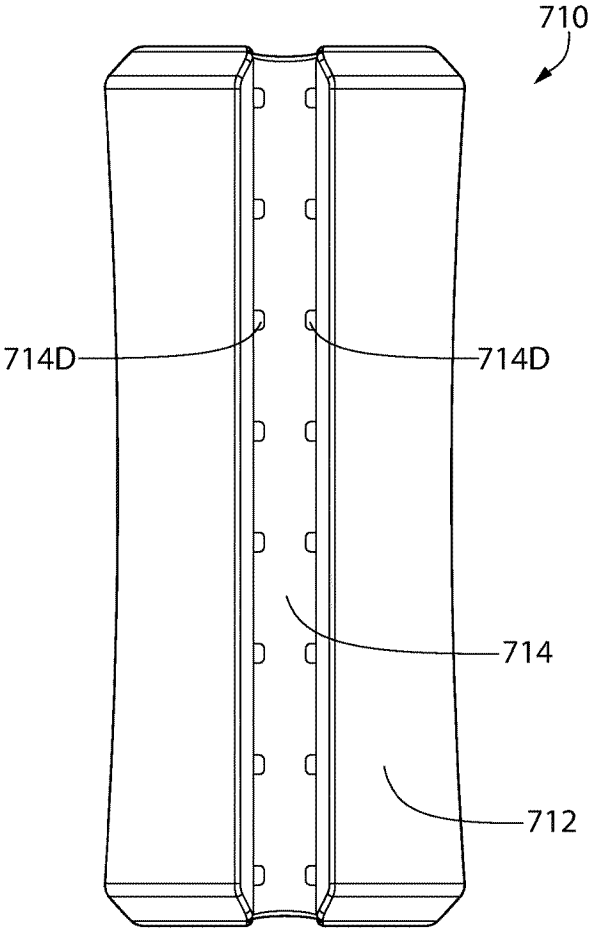
FIGS. 19A-19B are top and side views respectively of a shaft holding device according to another exemplary embodiment of the present invention.
Figure 19A:
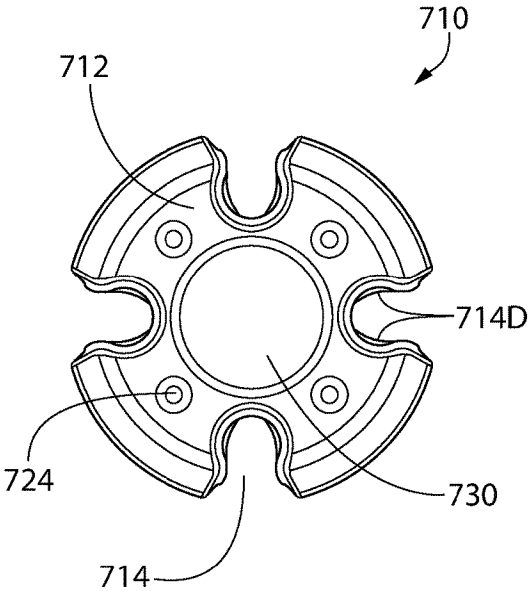

Referring to FIGS. 19A-19B, the body 712 may include one or more ribs 714*d* extending circumferentially around and projecting radially outwardly from the inner surface of the slot 714. The ribs 714*d* may be comprised of an elastomeric material and/or be crushable for retaining a shaft in the slot 714. In one embodiment, the ribs 714*d* are integrally formed with the body 712. In other embodiment, the ribs 714*d* are attached to the body 714*d*. The ribs 714*d* may be equally spaced along the length of the slot 714. In other embodiments, the ribs 714*d* are grouped together such as toward the ends where the diameter of the slot 714 is larger. In one embodiment, the ribs 714*d* project from the body 712 a generally equal distance to one another. In other embodiments, the ribs 714*d* project from the body 712 different amounts as compared to one another. For example, the slot 714*d* may have a generally constant diameter but the projection width of the ribs 714*d* may increase toward a mid-section of the body 712.

Figure 20B:
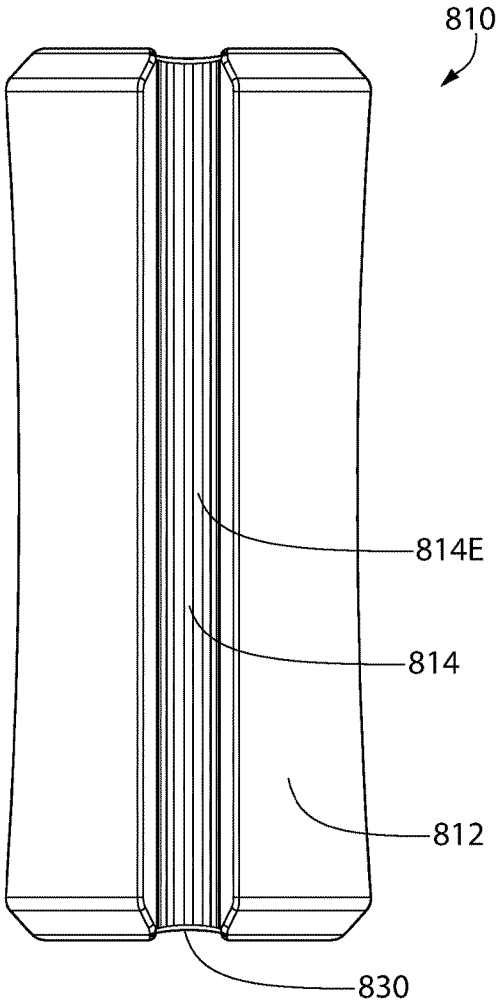
FIGS. 20A-20B are top and side views respectively of a shaft holding device according to another exemplary embodiment of the present invention.
Figure 20A:
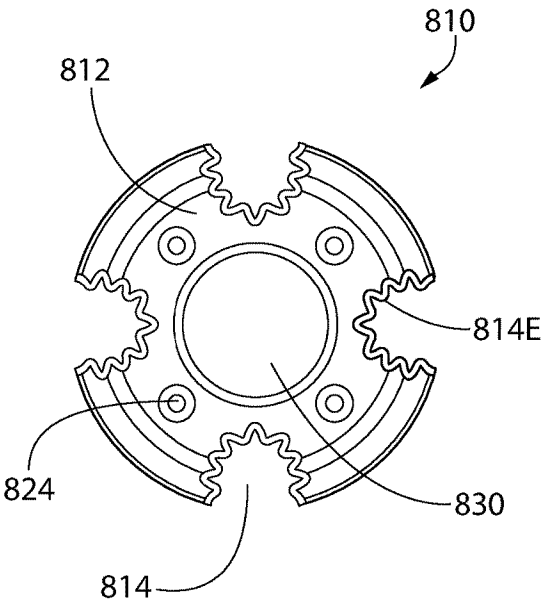

Referring to FIGS. 20A-20B, each slot 814 may have a ridged cross section forming a plurality of ribs 814*e*. The ribs may be configured to help engage and retain the shaft. Each rib 814*e* may extend along the entire length of slot 814. In other embodiments, the ribs 814*e* extend along only a portion of the length of the slot 814.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. Unless specifically set forth herein, the terms "a," "an" and "the" are not limited to one element but instead should be read as meaning "at least one."

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

We claim:

1. A shaft holding device comprising:

a body having a top and a bottom and a central axis extending between the top and the bottom, a length of the body measured along the central axis being larger than a largest dimension measured perpendicular to the central axis; and a plurality of slots formed by the body and each configured to releasably secure a shaft therein, each of the plurality of slots having an axis spaced from and generally parallel with the central axis, each of the plurality of slots being open along a side of the body and, for each cross section along the length of the body taken about a plane perpendicular to the central axis, each inner circumferential width of an opening of each of the plurality of slots being smaller than a diameter of each of the plurality of slots, wherein the body includes a core and an outer sleeve mounted on the core, wherein the core includes a plurality of arms, each of the plurality of arms extending radially between two adjacent slots of the plurality of slots, and wherein each of the plurality of arms includes a split finger end allowing for the circumferential width of each of the plurality of arms to be contracted.

2. The shaft holding device of claim 1, wherein the outer sleeve includes an elastomeric material.

3. The shaft holding device of claim 1, wherein the outer sleeve, including the plurality of slots, is symmetrical about three planes, each of the three planes being perpendicular to one another.

4. The shaft holding device of claim 1, wherein the body includes at least one aperture extending through the bottom and positioned radially closer to the central axis than each of the plurality of slots.

5. The shaft holding device of claim 4 further including:

a spike that is configured to releasable mount into the at least one aperture, the spike being generally parallel with the central axis when mounted into the at least one aperture, the spike configured to be releasably secured into one of the plurality of slots.

6. The shaft holding device of claim 4, wherein each of at least one aperture is configured to releasably retain a golf tee.

7. The shaft holding device of claim 1 further including:

a golf ball marker, wherein the top of the body includes a recess configured to receive the golf ball marker; and a magnet mounted to the body within the recess and configured to releasably retaining the golf ball marker.

8. The shaft holding device of claim 7 further comprising:

a threaded insert mounted to the body within the recess and configured to releasably mount a strap loop to the body.

9. The shaft holding device of claim 1, wherein the body forms an open compressible space between each of the plurality of slots.

10. The shaft holding device of claim 1, wherein the diameter of each of the plurality of slots and an outer circumferential width of each opening of the plurality of slots is larger toward the top and bottom of the body than corresponding dimensions in a mid-section of the body between the top and the bottom of the body.

11. The shaft holding device of claim 1 further comprising a carrying strap releasably coupled to the top and the bottom of the body.

12. The shaft holding device of claim 1, wherein the length of the body is less than 6 inches and the outermost diameter is less than 2.5 inches.

13. The shaft holding device of claim 1, wherein in the body tapers radially inwardly toward the center between the top and bottom.

14. The shaft holding device of claim 1, wherein the plurality of slots include six slots spaced equally around the central axis.

15. A shaft holding device, comprising:

a body having a top and a bottom and a central axis extending between the top and the bottom, a length of the body measured along the central axis being larger than a largest dimension measured perpendicular to the central axis; and a plurality of slots formed by the body and each configured to releasably secure a shaft therein, each of the plurality of slots having an axis spaced from and generally parallel with the central axis, each of the plurality of slots being open along a side of the body and, for each cross section along the length of the body taken about a plane perpendicular to the central axis, each inner circumferential width of an opening of each of the plurality of slots being smaller than a diameter of each of the plurality of slots, wherein the body includes a core and an outer sleeve mounted on the core, and wherein the core includes a top half and a bottom half that are coupled to one another inside of the outer sleeve, the top half of the core extending partially from the top of the outer sleeve and the bottom half of the core extending partially from the bottom of the outer sleeve.

16. The shaft holding device of claim 15, wherein the core includes a plurality of arms, each of the plurality of arms extending radially between two adjacent slots of the plurality of slots.

17. The shaft holding device of claim 16, wherein each of the plurality of arms each include a split finger end allowing for the circumferential width of each of the plurality of arms to be contracted.

18. The shaft holding device of claim 15, wherein the outer sleeve includes an elastomeric material.

19. A shaft holding device comprising:

a body having a top and a bottom and a central axis extending between the top and the bottom, a length of the body measured along the central axis being larger than a largest dimension measured perpendicular to the central axis, the body including an elastomeric material and tapering radially inwardly toward the center between the top and bottom;

a plurality of slots formed by the body and each configured to releasably secure a shaft therein, each of the plurality of slots having an axis spaced from and generally parallel with the central axis, each of the plurality of slots being open along a side of the body and, for each cross section along the length of the body taken about a plane perpendicular to the central axis, each inner circumferential width of an opening of each of the plurality of slots being smaller than a diameter of each of the plurality of slots, the diameter of each of the plurality of slots and an outer circumferential width of each opening of the plurality of slots is larger toward the top and bottom of the body than corresponding dimensions in a mid-section of the body between the top and the bottom of the body; and a core extending through the body, the top half of the core extending partially from the top of the outer sleeve and the bottom half of the core extending partially from the bottom of the outer sleeve, the core including a plurality of arms, each of the plurality of arms extending radially between two adjacent slots of the plurality of slots, each of the plurality of arms each including a split finger end allowing for the circumferential width of each of the plurality of arms to contract.

* * * * *